US009498961B2

(12) United States Patent
Kano et al.

(10) Patent No.: US 9,498,961 B2
(45) Date of Patent: Nov. 22, 2016

(54) PRINTING APPARATUS AND DRIVING METHOD THEREFOR

(71) Applicant: CANON KABUSHIKI KAISHA, Tokyo (JP)

(72) Inventors: Yutaka Kano, Yokohama (JP); Norihiro Kawatoko, Yokohama (JP); Fumiko Suzuki, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/854,269

(22) Filed: Sep. 15, 2015

(65) Prior Publication Data

US 2016/0096362 A1 Apr. 7, 2016

(30) Foreign Application Priority Data

Oct. 7, 2014 (JP) ..... 2014-206672

(51) Int. Cl.
*B41J 2/165* (2006.01)

(52) U.S. Cl.
CPC ..... *B41J 2/16585* (2013.01); *B41J 2/16526* (2013.01); *B41J 2002/1657* (2013.01)

(58) Field of Classification Search
CPC B41J 2/04563; B41J 2/0458; B41J 2/04581; B41J 2/04591; B41J 29/393
USPC ..... 347/5–19
See application file for complete search history.

(56) References Cited

U.S. PATENT DOCUMENTS 6,164,754 A 12/2000 Ide et al.
6,334,659 B1 1/2002 Maeda et al.
6,364,446 B1 4/2002 Ishikawa et al.
6,557,982 B2 5/2003 Murakami et al.
6,572,212 B2 6/2003 Konno et al.
6,580,460 B1 6/2003 Takahashi et al.
6,644,770 B1 11/2003 Niimura et al.
6,729,709 B2 5/2004 Konno et al.
6,733,100 B1 5/2004 Fujita et al.
6,808,247 B2 10/2004 Kawatoko et al.
6,827,413 B1 12/2004 Kawatoko et al.
6,921,218 B2 7/2005 Moriyama et al.
6,957,880 B2 10/2005 Kawatoko et al.
6,960,036 B1 11/2005 Fujita et al.

(Continued)

FOREIGN PATENT DOCUMENTS

JP 2005-246643 A 9/2005
JP 2012-030594 A 2/2012

*Primary Examiner* — Manish S Shah
*Assistant Examiner* — Roger W Pisha, II
(74) *Attorney, Agent, or Firm* — Fitzpatrick, Cella, Harper & Scinto

(57) ABSTRACT

A printing apparatus comprising a printhead including two nozzle arrays neighboring in a first direction, each including nozzles arrayed along a second direction, a conveying unit for conveying a sheet in the first direction, a driving unit for driving the printhead so that each nozzle performs preliminary discharge on the sheet, and a unit configured to perform selecting some nozzles as non-driving nozzles and the remaining nozzles as driving nozzles for every column data in image data, determining image data to be assigned to each array as a first data so that a dot corresponding the non-driving nozzle in one of the two arrays is printed by the driving nozzle in the other, determining data for preliminary discharge as a second data so that each driving nozzle performs preliminary discharge, and ORing the first and second data.

12 Claims, 23 Drawing Sheets

(56) References Cited

U.S. PATENT DOCUMENTS

| | | | | |
|---|---|---|---|---|
| 7,048,351 | B2 | 5/2006 | Kawatoko | |
| 7,057,756 | B2 | 6/2006 | Ogasahara et al. | |
| 7,290,855 | B2 | 11/2007 | Chikuma et al. | |
| 7,296,872 | B2 | 11/2007 | Hayashi et al. | |
| 7,325,900 | B2 | 2/2008 | Hayashi et al. | |
| 7,344,219 | B2 | 3/2008 | Sakamoto et al. | |
| 7,517,044 | B2 | 4/2009 | Suzuki et al. | 347/22 |
| 7,600,835 | B2 | 10/2009 | Moriyama et al. | |
| 7,618,116 | B2 | 11/2009 | Hamasaki et al. | |
| 7,706,023 | B2 | 4/2010 | Kanda et al. | |
| 7,775,622 | B2 | 8/2010 | Suzuki et al. | 347/22 |
| 7,959,246 | B2 | 6/2011 | Hamasaki et al. | |
| 8,287,074 | B2 | 10/2012 | Kano et al. | |
| 8,384,944 | B2 | 2/2013 | Kawatoko et al. | |
| 8,430,472 | B2 | 4/2013 | Nishikori et al. | |
| 8,444,246 | B2 | 5/2013 | Muro et al. | |
| 8,608,271 | B2 | 12/2013 | Murayama et al. | |
| 8,622,538 | B2 | 1/2014 | Miyakoshi et al. | |
| 8,675,250 | B2 | 3/2014 | Muro et al. | |
| 8,757,754 | B2 | 6/2014 | Azuma et al. | |
| 8,864,266 | B2 | 10/2014 | Suzuki et al. | |
| 8,876,280 | B2 | 11/2014 | Ishikawa et al. | |
| 8,955,956 | B2 | 2/2015 | Yamamoto et al. | |
| 8,979,238 | B2 | 3/2015 | Nishikori et al. | |
| 9,004,640 | B2 | 4/2015 | Ishikawa et al. | |
| 9,016,821 | B2 | 4/2015 | Masuda et al. | |
| 9,039,112 | B2 | 5/2015 | Murayama et al. | |
| 9,079,421 | B2 | 7/2015 | Kato et al. | |
| 9,108,403 | B2 | 8/2015 | Kawatoko et al. | |
| 9,138,989 | B2 | 9/2015 | Kawatoko et al. | |
| 9,174,436 | B2 | 11/2015 | Suzuki et al. | |
| 2005/0122373 | A1* | 6/2005 | Katsu | B41J 2/16526 347/22 |
| 2007/0139454 | A1* | 6/2007 | Hamasaki | B41J 2/04541 347/12 |
| 2011/0310152 | A1 | 12/2011 | Muro et al. | |
| 2012/0050375 | A1 | 3/2012 | Kano et al. | |
| 2012/0274951 | A1 | 11/2012 | Nishikori et al. | |
| 2015/0284202 | A1 | 10/2015 | Asano et al. | |

* cited by examiner

FIG. 5A
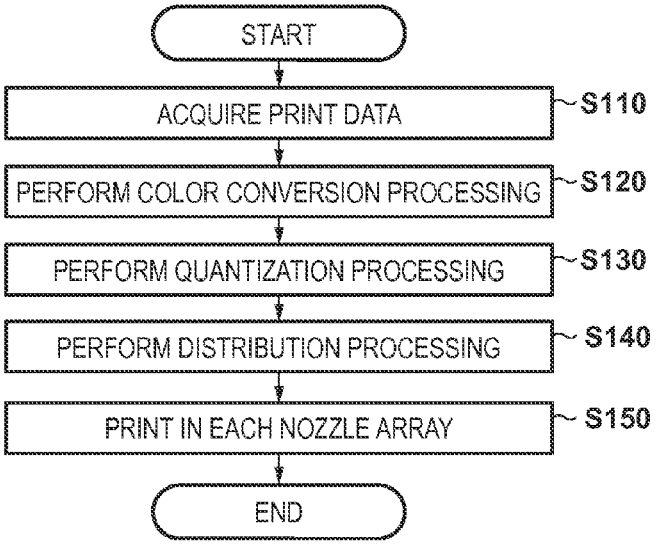
FIG. 5C
| Lv | NUMBER OF DOTS |
|---|---|
| 0 | 0 |
| 1 | 1 |
| 2 | 2 |
| 3 | 3 |
FIG. 5B
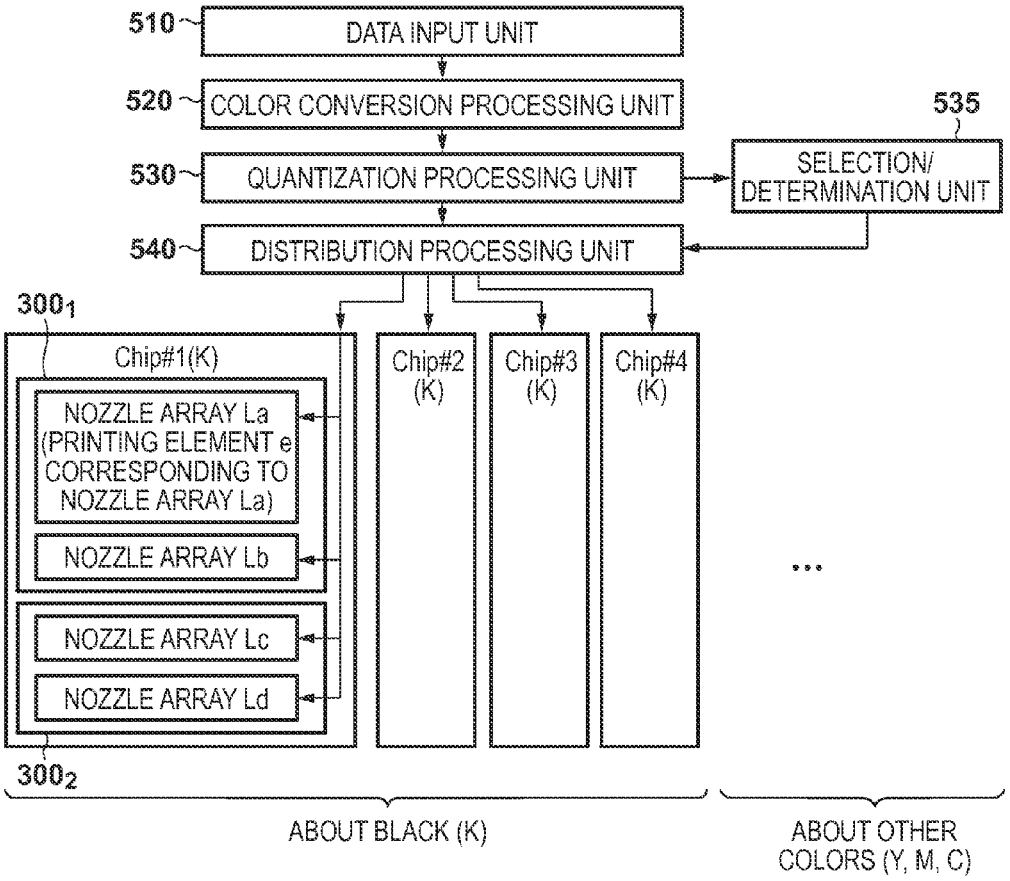

FIG. 7C

X (CONVEYING DIRECTION)

Y (NOZZLE ARRAY DIRECTION)

| B# | clm1 | clm2 | clm3 | clm4 |
|---|---|---|---|---|
| 1 | cda | dab | abc | bcd |
| 2 | dac | abd | bca | cdb |
| 3 | acd | bda | cab | dbc |
| 4 | cda | dab | abc | bcd |
| 5 | dab | abc | bcd | cda |
| 6 | abd | bca | cdb | dac |
| 7 | bda | cab | dbc | acd |
| 8 | dab | abc | bcd | cda |
| 9 | abc | bcd | cda | dab |
| 10 | bca | cdb | dac | abd |
| 11 | cab | dbc | acd | bda |
| 12 | abc | bcd | cda | dab |
| 13 | bcd | cda | dab | abc |
| 14 | cdb | dac | abd | bca |
| 15 | dbc | acd | bda | cab |
| 16 | bcd | cda | dab | abc |

TP1

FIG. 15A

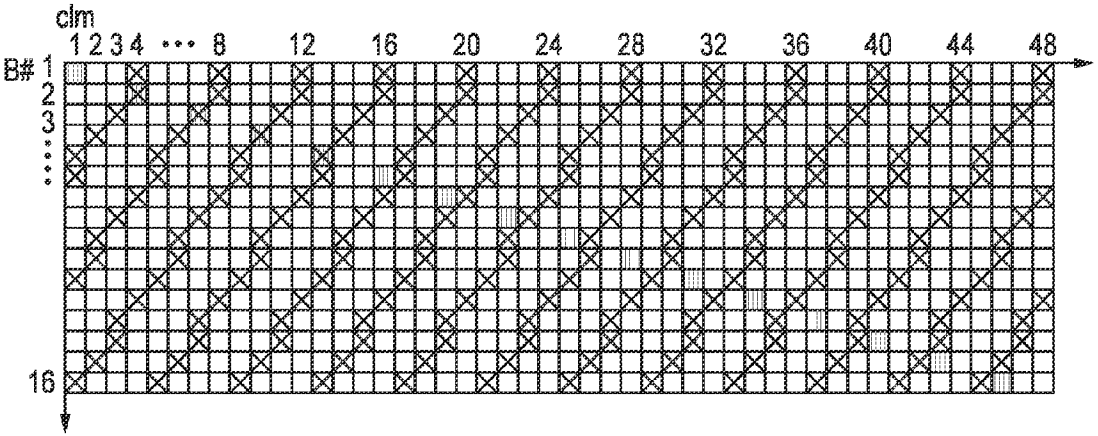

□: DATA CORRESPONDING TO DRIVING NOZZLE AND INDICATING THAT PRELIMINARY DISCHARGE IS NOT TO BE PERFORMED
☒: DATA CORRESPONDING TO NON-DRIVING NOZZLE AND INDICATING THAT PRELIMINARY DISCHARGE IS NOT TO BE PERFORMED
▨: DATA CORRESPONDING TO DRIVING NOZZLE AND INDICATING THAT PRELIMINARY DISCHARGE IS TO BE PERFORMED
⊠: DATA CORRESPONDING TO NON-DRIVING NOZZLE AND INDICATING THAT PRELIMINARY DISCHARGE IS TO BE PERFORMED

FIG. 15B

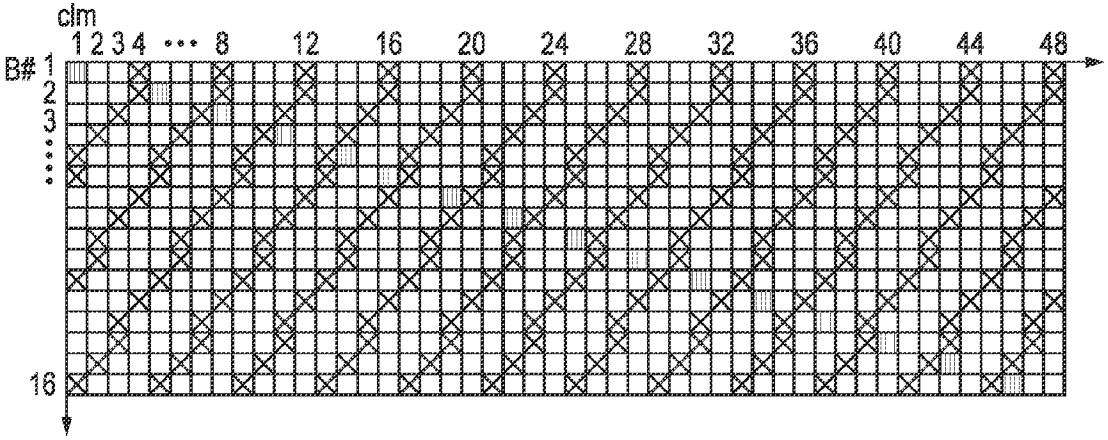

□: DATA CORRESPONDING TO DRIVING NOZZLE AND INDICATING THAT PRELIMINARY DISCHARGE IS NOT TO BE PERFORMED

☒: DATA CORRESPONDING TO NON-DRIVING NOZZLE AND INDICATING THAT PRELIMINARY DISCHARGE IS NOT TO BE PERFORMED

□: DATA CORRESPONDING TO DRIVING NOZZLE AND INDICATING THAT PRELIMINARY DISCHARGE IS TO BE PERFORMED

☒: DATA CORRESPONDING TO NON-DRIVING NOZZLE AND INDICATING THAT PRELIMINARY DISCHARGE IS TO BE PERFORMED

PRINTING APPARATUS AND DRIVING METHOD THEREFOR

BACKGROUND OF THE INVENTION

1. Field of the Invention

The present invention relates to a printing apparatus and a driving method therefor.

2. Description of the Related Art

A printing apparatus includes, for example, a printhead for printing on a printing medium, and a conveying roller for conveying the printing medium. A plurality of nozzles for printing dots by discharging ink are provided in an inkjet printhead, and each nozzle performs preliminary discharge at a predetermined interval. Preliminary discharge is one of recovery processes of the printhead to prevent clogging of each nozzle. Since nozzles whose driving frequency is relatively low can appropriately print dots by performing preliminary discharge, the quality of an image formed on a printing medium is improved.

Japanese Patent Laid-Open No. 2005-246643 discloses a technique of performing "preliminary discharge on a sheet" to print dots by preliminary discharge on a printing medium at a density which has no influence on the visibility. Preliminary discharge on a sheet is advantageous in, for example, improving the image quality in an arrangement in which printing is executed on a printing medium such as a longitudinally long-shaped sheet (roll sheet) using a full-line printhead while conveying the printing medium.

In some printing apparatuses, a printhead includes two or more nozzle arrays which are used to print dots of the same color and each of which has a plurality of nozzles arranged along a predetermined direction. Print data are distributed to the respective nozzle arrays, and each nozzle array is driven based on the distributed print data. This arrangement is advantageous in improving the print speed since the two or more nozzle arrays are driven in parallel to print dots according to the print data.

Japanese Patent Laid-Open No. 2012-30594 (e.g. FIG. 8C) discloses a technique in which the nozzles of each group of two nozzle arrays are time-divisionally driven, and each nozzle array is time-divisionally driven by shifting the driving timings by a ½ period of time-divisional driving. Similarly, Japanese Patent Laid-Open No. 2012-30594 (e.g. FIG. 11C) discloses a technique in which the nozzles of each group of four nozzle arrays are time-divisionally driven, and each nozzle array is time-divisionally driven by shifting the driving timings by a ¼ period of time-divisional driving.

In the arrangement described in Japanese Patent Laid-Open No. 2012-30594, however, when the conveying speed of a printing medium is increased to improve the throughput, it is necessary to increase the operation speed of each nozzle array (for example, the driving frequency of each nozzle array) so that dots are appropriately printed on the printing medium at a speed corresponding to the conveying speed. This requires the user to change a design of hardware such as the circuit design of a printing apparatus along with a change in operation speed, leading to an increase in manufacturing cost.

Furthermore, in the arrangement described in Japanese Patent Laid-Open No. 2012-30594, when time-divisionally driving each nozzle array, one period of time-divisional driving corresponds to a plurality of column data, and thus a nozzle array capable of printing dots on the printing medium is limited (a nozzle array to be used is fixed for each pixel). At this time, it may be impossible to perform preliminary discharge on sheet by a desired nozzle. Therefore, if data for preliminary discharge in which only usable nozzles are selected are generated in advance and stored in the memory of the printing apparatus in order to make it possible to perform preliminary discharge on a sheet by all nozzles, a large-capacity memory is required to store data for preliminary discharge of the entire print region for each ink color or each nozzle array, leading to an increase in manufacturing cost.

SUMMARY OF THE INVENTION

The present invention provides a technique for a new driving method of two or more nozzle arrays, which is advantageous in performing preliminary discharge on a sheet while maintaining a print speed with a simple and low-end arrangement.

One of the aspects of the present invention provides a printing apparatus, including an inkjet printhead with not less than two nozzle arrays arranged in a first direction, each nozzle array including a plurality of nozzles arranged along a second direction intersecting the first direction, the apparatus comprising a conveying unit configured to convey a longitudinally long-shaped sheet in the first direction, a driving unit configured to drive the printhead so that each nozzle performs preliminary discharge on the sheet conveyed by the conveying unit while printing a dot based on print data, and a unit, wherein the unit performs a first operation of expanding image data onto a memory in correspondence with the first direction and the second direction, a second operation of, in each nozzle array for every column data corresponding to the second direction in the expanded image data, selecting some of the plurality of nozzles as non-driving nozzles so the nozzles do not overlap each other between the nozzle arrays in the first direction, and the remaining nozzles of the plurality of nozzles as driving nozzles, a third operation of determining, for the expanded image data, image data to be assigned to each nozzle array so that when a portion of each column data indicating driving of a nozzle corresponds to a driving nozzle selected for the column data, the portion indicating driving is assigned to a nozzle array to which the driving nozzle belongs, and when a portion of each column data indicating driving of a nozzle corresponds to a non-driving nozzle selected for the column data, the portion indicating driving is assigned to another nozzle array different from a nozzle array to which the non-driving nozzle belongs, a fourth operation of generating data for preliminary discharge which corresponds to the image data determined in the third operation and is used by the plurality of nozzles of each nozzle array to discretely perform preliminary discharge on the sheet in at least one of the first direction and the second direction, by setting, when the nozzle selected as the driving nozzle in the second operation for given column data is set as a preliminary discharge target, the column data as data used by the nozzle to perform preliminary discharge, and setting, when the nozzle selected as the non-driving nozzle in the second operation for given column data is set as a preliminary discharge target, another column data, which is different from the column data and in which the nozzle is selected as the driving nozzle in the second operation, as data used by the nozzle to perform preliminary discharge, and a fifth operation of generating print data by ORing the image data determined in the third operation and the data for preliminary discharge generated in the fourth operation, and outputting the print data to each nozzle array.

Further features of the present invention will become apparent from the following description of exemplary embodiments with reference to the attached drawings.

BRIEF DESCRIPTION OF THE DRAWINGS

FIGS. 5A to 5C are views for explaining an example of a print data processing method;

FIGS. 7A to 7C are views for explaining an example of the print data processing method;

FIGS. 15A and 15B are views for explaining an example of data for preliminary discharge changed in correspondence with the restriction pattern;

DESCRIPTION OF THE EMBODIMENTS

1. Example of Arrangement of Printing Apparatus

Figure 1:
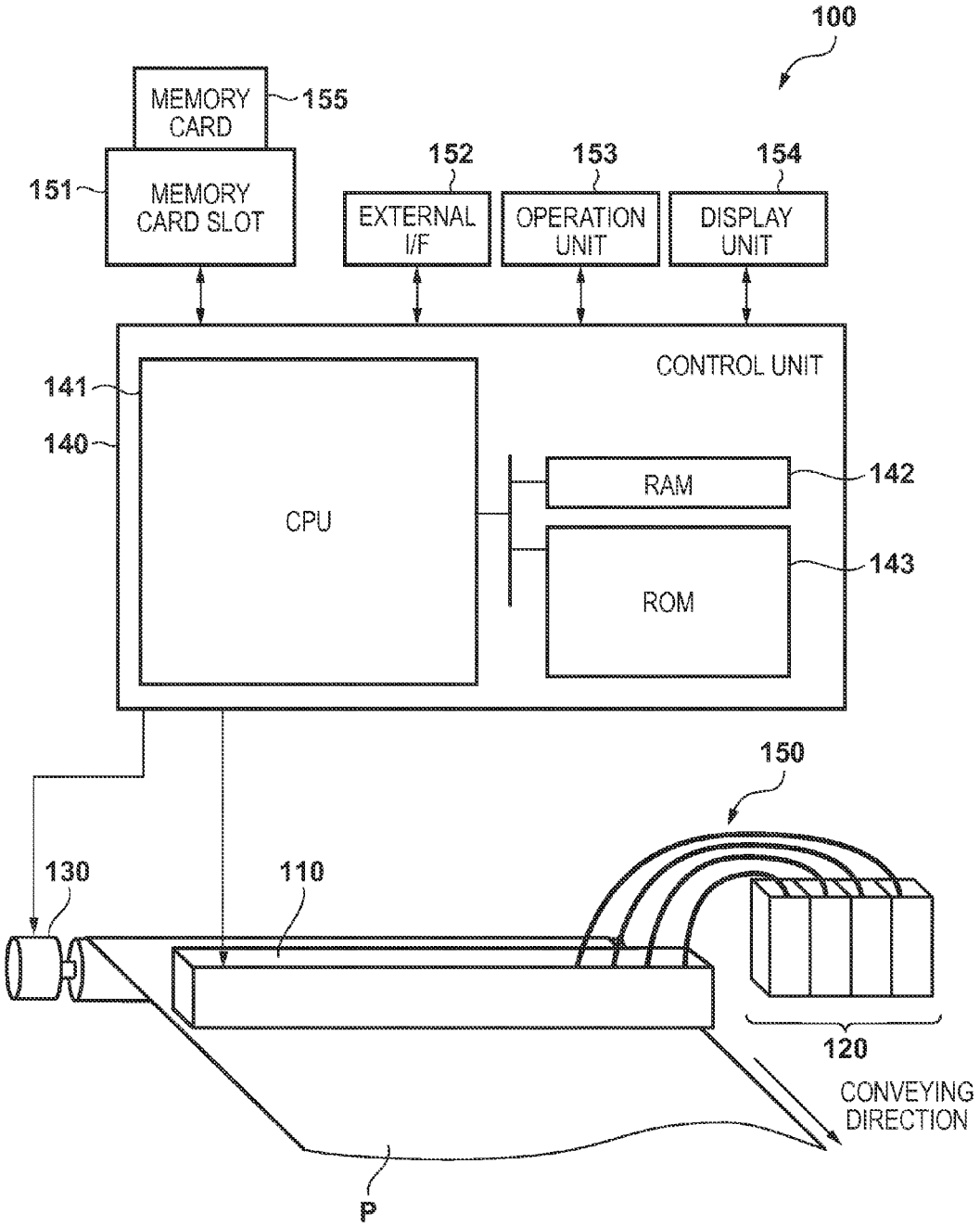
FIG. 1 is a view for explaining an example of the overall arrangement of a printing apparatus.

FIG. 1 is a schematic view for explaining an example of the overall arrangement of an inkjet printing apparatus 100 (to be also simply referred to as an "apparatus 100" hereinafter). The printing apparatus 100 includes a printhead 110 for printing on a printing medium, ink cartridges 120 for supplying inks (printing agents) to the printhead 110, a conveying roller 130 for conveying the printing medium, and a control unit 140. For example, a roll sheet P (to be also simply referred to as a "sheet P" hereinafter) as a longitudinally long-shaped sheet can be used as a printing medium.

A plurality of nozzles are arranged along a predetermined direction in the printhead 110, and ink dots (dots) are printed on the sheet P by discharging ink droplets from the nozzles. The printhead 110 adopts a so-called full-line arrangement, and can perform printing at the full width (for example, about 18 inches) on the sheet P at once.

When the apparatus 100 supports color printing, the ink cartridges 120 are provided in correspondence with respective colors (for example, yellow (Y), magenta (M), cyan (C), and black (K)). In this example, the four ink cartridges 120 are provided. Ink in each ink cartridge 120 is supplied to the printhead 110 via, for example, an ink inlet pipe 150. Note that the color types and the number of colors are not limited to those in this example.

The conveying roller 130 conveys the sheet P in a direction intersecting the array direction of the plurality of nozzles in the printhead 110. In this specification, the array direction of the nozzles will be simply referred to as a "nozzle array direction" hereinafter, and the conveying direction of the sheet P will be simply referred to as a "conveying direction" hereinafter.

Note that only the conveying roller 130 is shown for the sake of simplicity. The apparatus 100 may further include other conveying units. For example, the apparatus 100 includes a paper feed unit for feeding the sheet P to a path for executing printing on the sheet P and each process associated with printing, a plurality of conveying rollers for conveying the sheet P from the paper feed unit, and a plurality of motors for driving the plurality of conveying rollers.

The control unit 140 includes, for example, a CPU 141 and a memory such as a RAM 142 and ROM 143, and controls the respective units of the apparatus 100 based on, for example, a print job including a control command and image data. More specifically, for example, the CPU 141 reads out a program for printing from the ROM 143 and expands it onto the RAM 142, and also expands image data onto the RAM 142, thereby performing data processing based on the program for the image data. The CPU 141 drives the conveying roller 130 while driving the printhead 110 based on the image data having undergone the data processing.

Note that upon start of printing based on print data having undergone the above data processing, before the printing is completed, preparations for printing based on next print data are started by expanding the next print data onto the RAM 142, and performing the same data processing. By repeating this operation, one or more images corresponding to a print job input to the apparatus 100 are formed on the sheet P without interrupting a print operation.

With the above arrangement, while the sheet P is conveyed in the conveying direction, dots are printed on the sheet P by the respective nozzles of the printhead 110, and images corresponding to the image data are formed on the sheet P. Note that in this specification, an "image" can include a region such as a blank where no dots are printed, in addition to characters, graphics, symbols, and other objects formed by one or more dots, which are formed in an effective region of the roll sheet P. An image formed in a region corresponding to a unit page of the roll sheet P will also be referred to as an "image for one page" or "unit image" hereinafter.

The apparatus 100 may further include a memory card slot 151, an external interface (external I/F) 152, an operation unit 153, and a display unit 154. These units are connected to the control unit 140 via, for example, a system bus, and can exchange image data or a control command. For example, a memory card 155 is inserted to the memory card slot 151, and the control unit 140 can read out image data held in the memory card 155, and perform control based on the image data. For example, the control unit 140 may receive image data via the external interface 152, and control each unit based on the image data. Furthermore, for example, the user can set print information via the operation unit 153, and the control unit 140 may control each unit based on the information. The display unit 154 can display a print status and the state of the apparatus 100, as needed, and the user can refer to the display unit 154.

Figure 2A:
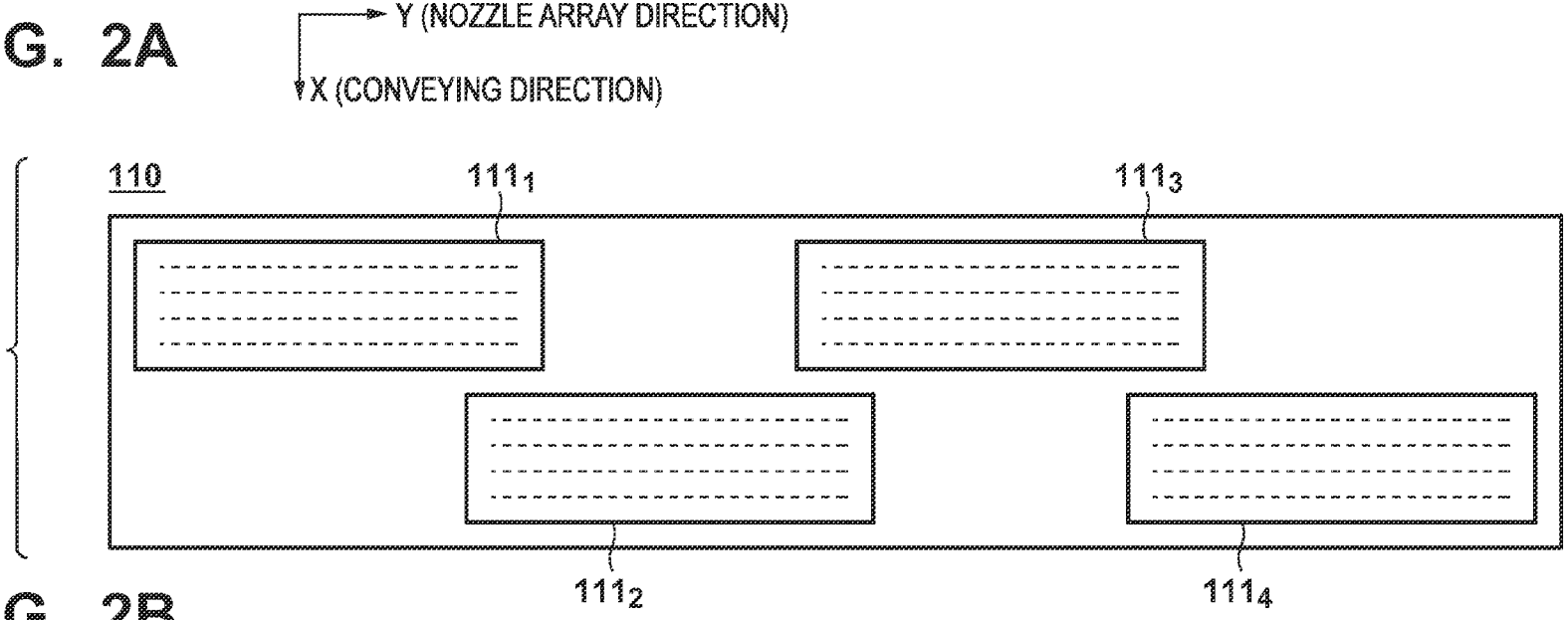
FIGS. 2A and 2B are views for explaining an example of the arrangement of a full-line printhead.
Figure 2B:
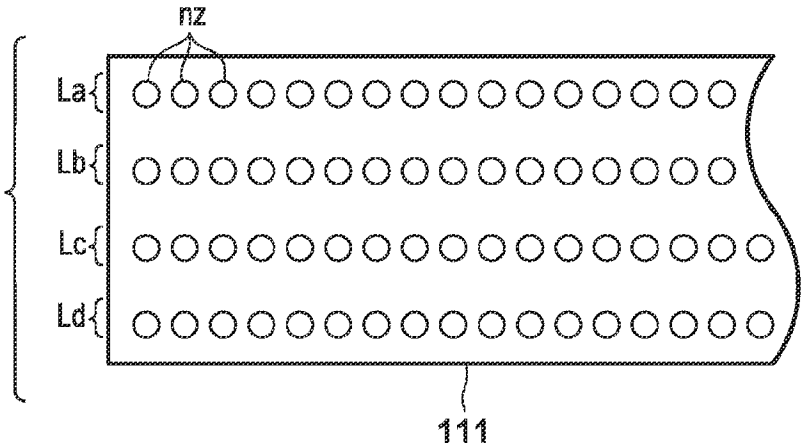

FIGS. 2A and 2B are schematic views for explaining a portion, corresponding to one color (for example, K), of an example of the arrangement of the printhead 110. As exemplified in FIG. 2A, a plurality of nozzle substrates 111 such as $\mathbf{111}_1$ are arranged in a staggered pattern on the surface of the printhead 110, which is used to perform printing. As exemplified in FIG. 2B, four nozzle arrays L, that is, La to Ld for printing dots of the same color (in this example, K) are provided in each nozzle substrate 111. Each nozzle array L includes a plurality of nozzles nz arranged at predetermined pitches (for example, 1,200 dpi) in a direction intersecting the conveying direction of the sheet P. Referring to FIGS. 2A and 2B, the conveying direction of the sheet P is represented by "X" and the nozzle array direction is represented by "Y". The full-line printhead 110 is formed to have such arrangement. Note that the number of nozzle arrays L and the number of nozzle substrates 111 are not limited to those in this example. Although the four nozzle arrays L have been exemplified for one color (K) for the sake of simplicity, the same applies to the remaining three colors (Y, M, and C).

Figure 3:
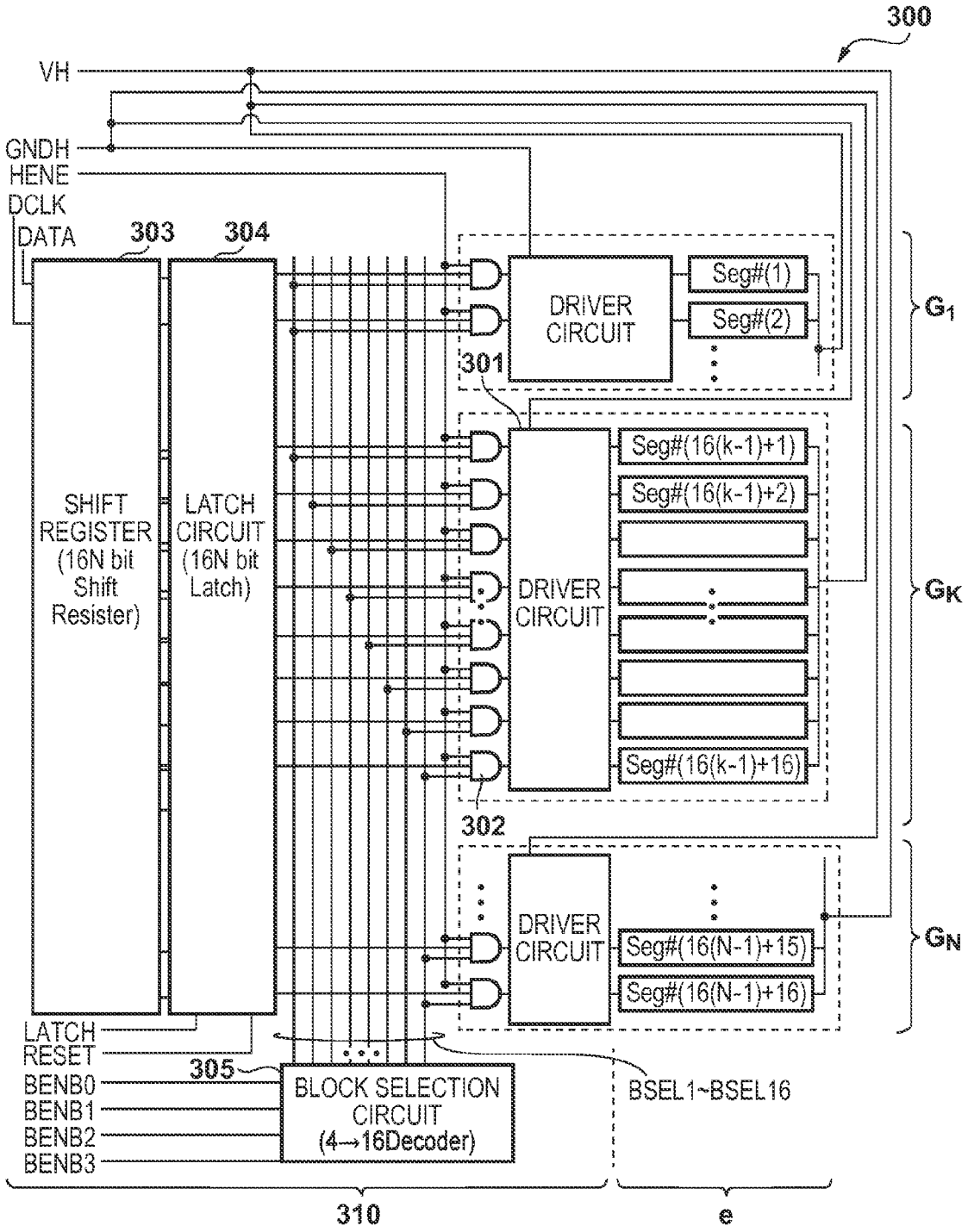
FIG. 3 is a view for explaining an example of the arrangement of a printing element substrate.

FIG. 3 shows an example of the arrangement of a printing element substrate 300 (to be simply referred to as an "element substrate 300" hereinafter). Element substrates $\mathbf{300}_1$, $\mathbf{300}_2$, $\mathbf{300}_3$, and $\mathbf{300}_4$ corresponding to the nozzle arrays La, Lb, Lc, and Ld are provided in the printhead 110. Note that the element substrates $\mathbf{300}_1$, $\mathbf{300}_2$, $\mathbf{300}_3$, and $\mathbf{300}_4$ can be provided for each nozzle substrate 111.

Note that in this specification, when the element substrates $\mathbf{300}_1$, $\mathbf{300}_2$, $\mathbf{300}_3$, and $\mathbf{300}_4$ are not specifically discriminated, they are simply referred to as the "element substrates 300".

The element substrate 300 includes a plurality of printing elements e and a logic circuit 310 for driving the plurality of printing elements e. Each of the plurality of printing elements e corresponds to each nozzle nz, and an electrothermal transducer (heater) can be used as each printing element e. The logic circuit 310 specifically includes driver circuits 301, AND circuits 302, a shift register 303, a latch circuit 304, and a block selection circuit 305. In accordance with a signal from the logic circuit 310, each printing element e is driven to generate heat energy, and the corresponding nozzle nz discharges an ink droplet by the heat energy. This is also expressed as "the nozzle is driven".

The plurality of printing elements e are divided into N groups G, that is, $G_1$ to $G_N$ so that each group includes 16 printing elements e (N is an integer of 2 or more). More specifically, a segment number (Seg#) is assigned to each of the plurality of printing elements e, and a given group $G_k$ includes 16 printing elements e of Seg#(16(k−1)+1) to Seg#(16(k−1)+16) (k is an integer of 1 to N).

The element substrate $\mathbf{300}_1$ corresponding to the nozzle array La will be exemplified. In this case, among the 16 printing elements e of the group $G_k$, the 16 printing elements e of Seg#(16(k−1)+1), Seg#(16(k−1)+2), . . . , Seg#(16(k−1)+16) correspond to the nozzles nz of the nozzle array La.

Block numbers B#B1 to B#16 are also assigned to the 16 printing elements e, respectively. For example, in the group $G_k$, the printing element e of Seg#(16(k−1)+1) belonging to the nozzle array La or the like is assigned with B#1. That is, B#1 : Seg#(16 (k−1)+1 )

Similarly,

B#2 : Seg#(16(k−1)+2)
B#3 : Seg#(16(k−1)+3)
B#4 : Seg#(16(k−1)+4)
B#5 : Seg#(16(k−1)+5)
B#6 : Seg#(16(k−1)+6)
B#7 : Seg#(16(k−1)+7)
B#8 : Seg#(16(k−1)+8)
B#9 : Seg#(16(k−1)+9)
B#10 : Seg#(16(k−1)+10)
B#11 : Seg#(16(k−1)+11)
B#12 : Seg#(16(k−1)+12)
B#13 : Seg#(16(k−1)+13)
B#14 : Seg#(16(k−1)+14)
B#15 : Seg#(16(k−1)+15)
B#16 : Seg#(16(k−1)+16)

Similarly, segment numbers (Seg#) and block numbers (B#) are assigned to the corresponding nozzles nz.

Each of the printing elements e of each group G is driven for each block together with the corresponding printing elements e of other groups G. More specifically, the respective printing elements e of the same block number are simultaneously driven. For example, the printing element e of Seg#(1) of the group $G_1$ and that of Seg#(16(k−1)+1) of the group $G_k$ belong to the same block, that is, B#1, and are driven at substantially the same timing. The printing elements e belonging to the respective blocks are sequentially driven.

This driving method will also be referred to as "time-divisional driving" hereinafter, the block will also be referred to as a "time-divisional driving block" or simply a "time-divisional block" hereinafter, and the group will also be referred to as a "time-divisional driving group" or simply a "time-divisional group" hereinafter.

The shift register 303 is a 16×N-bit shift register, and sequentially shifts data DATA every time a clock signal DCLK is received from the control unit 140.

The latch circuit 304 is a 16×N-bit latch circuit, and latches the 16×N-bit data DATA of the shift register 303 in response to a latch signal LATCH from the control unit 140. The latched data DATA will also simply be referred to as "latch data" hereinafter. For example, the latch circuit 304 initializes the latch data upon receiving a reset signal RESET from the control unit 140.

The block selection circuit 305 functions as a decoder and, for example, generates a block selection signal BSEL, that is, BSEL1 to BSEL16 upon receiving block enable signals BENB0 to BENB3 from the control unit 140. The block selection signal BSEL is a control signal for selecting a specific block whose printing elements e are to be driven.

Each AND circuit 302 is provided in correspondence with each printing element e. Each AND circuit 302 receives the latch data of the latch circuit 304, the block selection signal BSEL, and a heat enable signal HENB for defining the driving time of the printing element e, and outputs a driving signal to the driver circuit 301.

A heater voltage VH and a ground voltage GNDH corresponding to it are supplied to the driver circuit 301, and the driver circuit 301 boosts the driving signal from the AND circuit 302 and supplies it to the printing element e. This drives the printing element e, that is, drives the corresponding nozzle nz to discharge an ink droplet.

Figure 4:
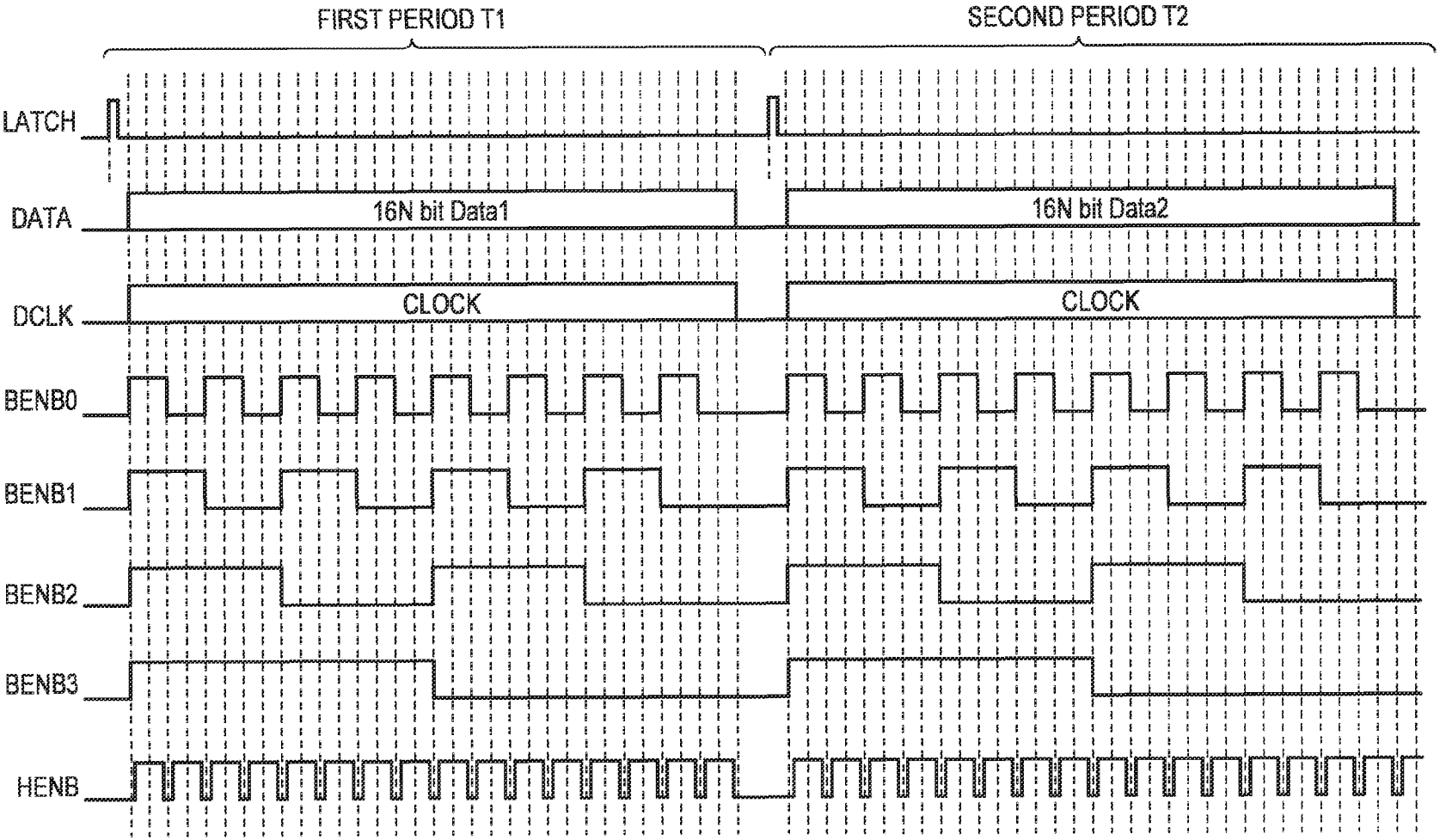
FIG. 4 is a timing chart for explaining an example of a driving method of the printing element substrate.

FIG. 4 shows a reference example of a timing chart for driving the element substrate 300. For example, during a first period T1, the latch signal LATCH is received, and the latch circuit 304 latches data DATA1 corresponding to the period T1. After that, the block enable signal BENB0 is alternately set at high or low level in a predetermined cycle. During this period, the block enable signals BENB1 to BENB 3 are alternately set at high or low level in cycles twice, four times, and eight times that of the signal BENB0, respectively. During the period T1, one of the 16 blocks, that is, B#B1 to B#16 is sequentially selected. The selected printing element e is driven based on the data DATA1.

Furthermore, during the period T1, the shift register 303 receives the clock signal DCLK, and shifts data DATA2 for a second period T2. In response to the latch signal LATCH during the period T2, the latch circuit 304 latches the data DATA2. After that, the same processing as that during the period T1 is performed.

(2. First Embodiment)

The first embodiment will be described below with reference to FIGS. 5A to 13B.

(2-1. Driving Method of Printing Apparatus)

FIGS. 5A to 5C are views for explaining an example of an image data processing method. FIG. 5A is a flowchart illustrating an example of the image data processing method. FIG. 5B is a block diagram for explaining a data flow corresponding to the flowchart.

In step S110 (to be simply referred to as "S110" hereinafter; the same applies to other steps), image data input from a data input unit 510 are acquired. More specifically, as described with reference to FIG. 1, the image data can be externally input via an external interface 152 or the like, and expanded onto a RAM 142 of a control unit 140 or the like. The obtained image data are 8-bit, 256-tone data for three colors of red (R), green (G), and blue (B).

In S120, a color conversion processing unit 520 performs color conversion processing (color space conversion processing) for the input image data. The image data are converted into 8-bit, 256-tone data for respective colors corresponding to ink colors. For example, in this example in which color printing is executed using four ink colors of Y (yellow), M (magenta), C (cyan), and K (black), data for the four colors of Y, M, C, and K are generated. The image data having undergone the color conversion processing undergoes data processing for each color.

In S130, a quantization processing unit 530 performs quantization processing for the image data for each color, which has undergone the color conversion processing. The quantization processing includes data processing by, for example, an error diffusion method or dither matrix method. Assuming that unit data corresponding to a given print position is a "pixel value" in the image data, the error diffusion method performs quantization processing for each pixel value in accordance with the difference from its peripheral pixel value. The image data can be converted into, for example, four-level data (one of levels 0 to 3) by the error diffusion method.

FIG. 5C shows the number of dots corresponding to each level value for the image data converted into the four-level data (one of levels 0 to 3). Referring to FIG. 5C, if, among the image data, data corresponding to a given print position is at level 1 (Lv1), one dot is printed at the print position. If data corresponding to a given print position is at level 2 (Lv2), two dots are printed at the print position. If data corresponding to a given print position is at level 3 (Lv3), three dots are printed at the print position. Furthermore, if data corresponding to a given print position is at level 0 (Lv0), no dot is printed at the print position. Note that if image data undergoes quantization processing and is converted into multi-level data, it is possible to increase the gamut of an image to be formed on the sheet P.

In S140, a distribution processing unit 540 performs distribution processing for the image data for the respective colors, which have undergone the quantization processing, thereby distributing the image data to the respective nozzle arrays L of the printhead 110. More specifically, the image data are distributed to the respective element substrates 300 so as to appropriately print dots by the corresponding nozzle arrays L.

The distribution processing unit 540 performs distribution processing based on a result of selection or determination by a selection/determination unit 535 and a detailed description thereof will be provided later. The selection/determination unit 535 selects, among the plurality of nozzles nz, nozzles (driving nozzles) which can be driven to perform printing according to the image data and nozzles (non-driving nozzles) which are not driven, and determines specific ones of the driving nozzles, which are to be used for printing.

Note that as described above with reference to FIG. 2A, each nozzle array L is formed by the plurality of nozzle substrates 111 arranged in a staggered pattern. Therefore, between the two nozzle substrates 111 adjacent to each other in the conveying direction, portions of the two chips overlap each other in the conveying direction. In this case, the image data need only be distributed so that dots are printed by one of the overlapping portions.

In S150, the printhead 110 is driven based on the distributed image data to print dots on the sheet P by the respective nozzle arrays L.

Note that with respect to the above-described processing units 520 to 540, the control unit 140 may include dedicated arithmetic processing units corresponding to them or the CPU 141 may have functions corresponding to them.

Figure 6:
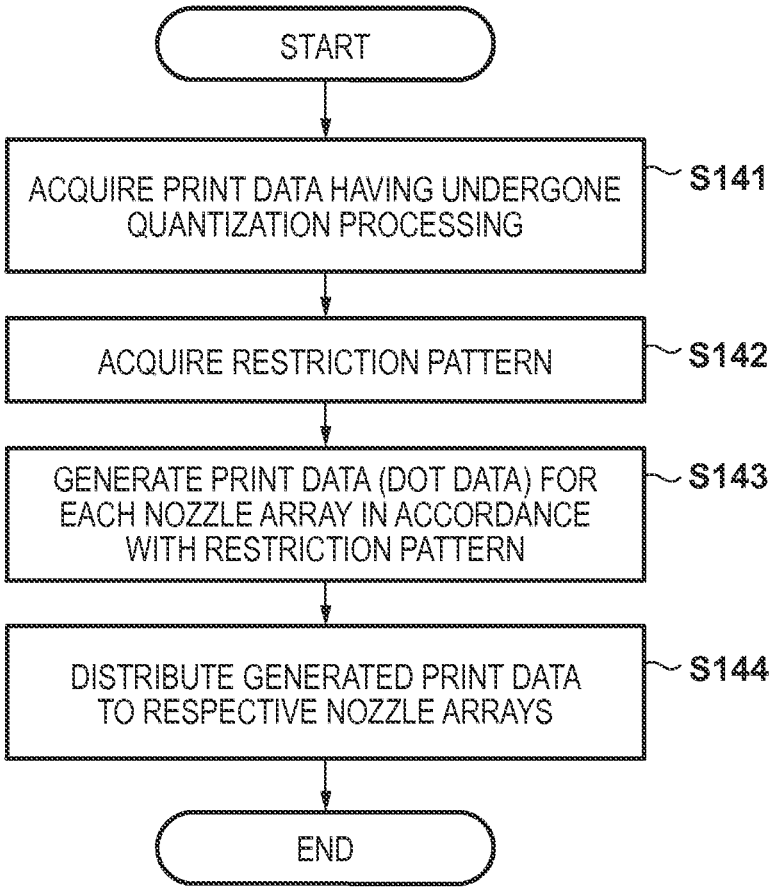
FIG. 6 is a flowchart for explaining an example of the print data processing method.

FIG. 6 is a flowchart for explaining details of the distribution processing in S140. In S141, the image data having undergone the quantization processing in S130 are acquired. In S142, restriction patterns each for defining driving nozzles and non-driving nozzles of the plurality of nozzles nz are acquired. After that, in S143, in accordance with the acquired restriction patterns, image data to be assigned to the respective nozzle arrays L are generated (or determined). Lastly, in S144, the generated image data are distributed to the nozzle arrays L. A practical example of the above flowchart will be described below with reference to FIGS. 7A to 7C, 8A, and 8B.

Figure 7A:
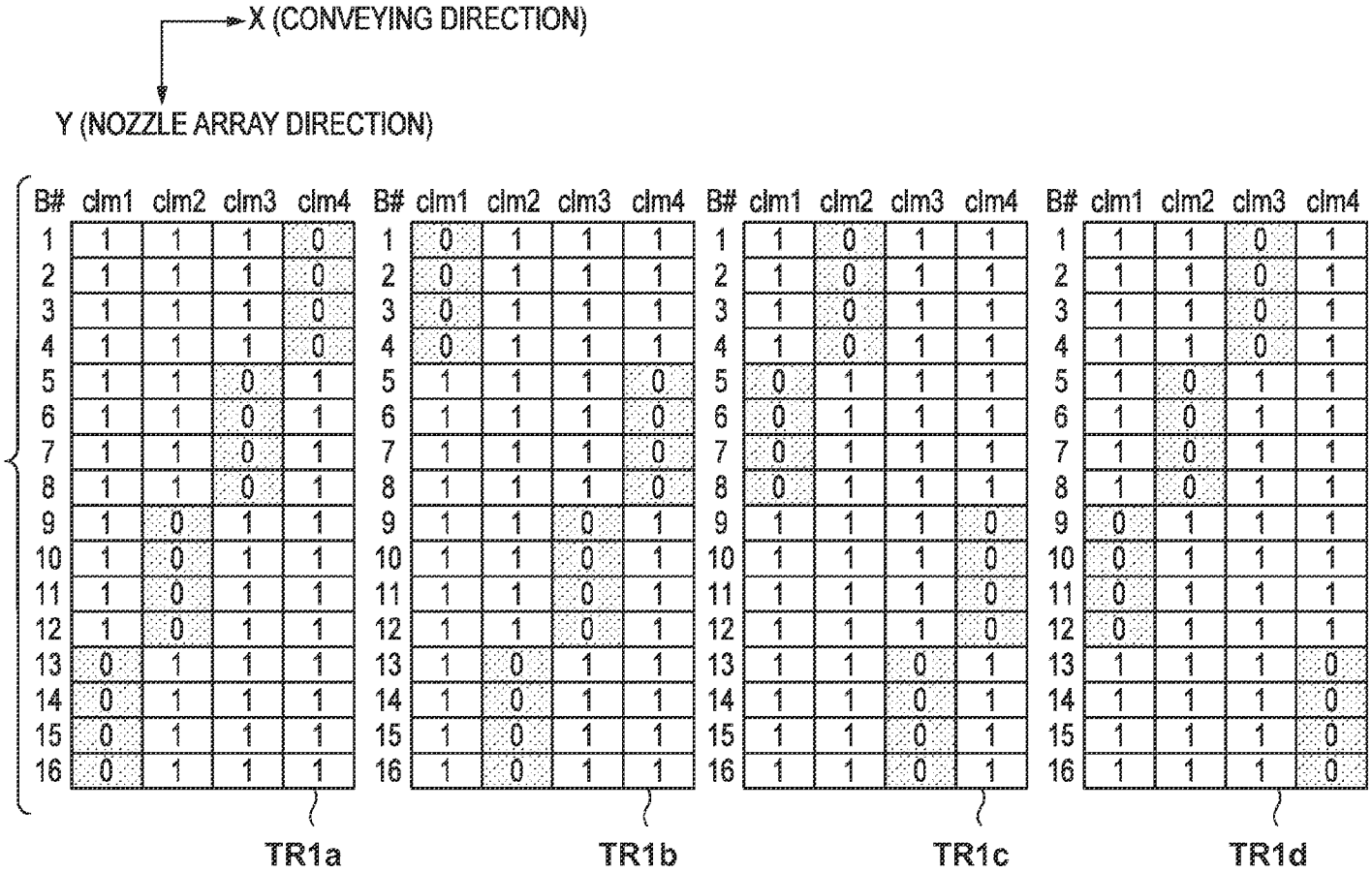

FIG. 7A is a view for explaining the restriction patterns each for defining driving nozzles and non-driving nozzles of the plurality of nozzles nz.

Assume that on the sheet P, a region where it is possible to print dots by driving all the driving nozzles once among the driving nozzles and non-driving nozzles is set as a "unit column". That is, assuming that the unit period of time-divisional driving is the time required to drive all the driving nozzles once, the unit column indicates a region where it is possible to print dots for one period of time-divisional driving, and can also indicate a region with a unit pixel width (for example, 1,200 dpi). Data for one column corresponding to the unit column in the image data will be referred to as "unit column data" or simply "column data" hereinafter. Each column data corresponds to the nozzle array direction Y.

For the sake of simplicity, restriction patterns each for four columns will be described using the block numbers B#B1 to B#16.

Each restriction pattern defines driving nozzles and non-driving nozzles for every column unit. In other words, each restriction pattern is a reference table for selecting, for each column data of the image data, nozzles (that is, driving nozzles) which can be driven to print dots corresponding to the column data and nozzles (that is, non-driving nozzles) driving of which is limited. Each restriction pattern need only be stored in, for example, the ROM 143 (see FIG. 1), and can be expanded onto the RAM 142, as needed.

For example, with respect to a restriction pattern TR1*a* to be applied to the nozzle array La, in a first column clm1, the nozzles nz of B#1 to B#12 are driving nozzles and the nozzles nz of B#13 to B#16 are non-driving nozzles. To discriminate between the driving nozzles and the non-driving nozzles, the boxes of the non-driving nozzles are hatched in FIG. 7A.

Similarly, with respect to a restriction pattern TR1*b* to be applied to the nozzle array Lb, in the column clm1, the nozzles nz of B#5 to B#16 are driving nozzles and the nozzles nz of B#1to B#4 are non-driving nozzles. With respect to a restriction pattern TR1*c* to be applied to the nozzle array Lc, in the column clm1, the nozzles nz of B#1 to B#4 and B#9 to B#16 are driving nozzles and the nozzles nz of B#5 to B#8 are non-driving nozzles. With respect to a restriction pattern TR1*d* to be applied to the nozzle array Ld, in the column clm1, the nozzles nz of B#1 to B#8 and B#13 to B#16 are driving nozzles and the nozzles nz of B#9 to B#12 are non-driving nozzles.

That is, some of the plurality of nozzles nz of each group G are selected as "non-driving nozzles" so the non-driving nozzles do not overlap each other between the nozzle arrays L in the conveying direction X, and the remaining nozzles are selected as "driving nozzles".

In this example, with respect to the column clm1, the nozzles nz of B#1 to B#4 in the nozzle array Lb are non-driving nozzles, and dots corresponding to these nozzles are printed by driving nozzles in at least one of the nozzle arrays La, Lc, and Ld. That is, in this example, with respect to the column clm1, dots corresponding to the nozzles nz of B#1 to B#4 are printed by the corresponding nozzles nz of at least one of the nozzle arrays La, Lc, and Ld.

Similarly, dots corresponding to the nozzles nz of B#5 to B#8 are printed by the corresponding nozzles nz of at least one of the nozzle arrays La, Lb, and Ld. Dots corresponding to the nozzles nz of B#9 to B#12 are printed by the corresponding nozzles nz of at least one of the nozzle arrays La, Lb, and Lc. Dots corresponding to the nozzles nz of B#13 to B#16 are printed by the corresponding nozzles nz of at least one of the nozzle arrays Lb, Lc, and Ld.

In a second column clm2, third column clm3, and fourth column clm4, the block numbers corresponding to the diving nozzles and non-driving nozzles are sequentially shifted by four. For example, with respect to the restriction pattern TR1*a*, the nozzles nz of B#9 to B#12 are non-driving nozzles in the column clm2, the nozzles nz of B#5 to B#8 are non-driving nozzles in the column clm3, and the nozzles nz of B#1 to B#4 are non-driving nozzles in the column clm4. The same applies to the restriction patterns TR1*b* to TR1*d*.

In summary, the "driving nozzles" selected by the restriction pattern are the nozzles nz which can be driven to perform printing according to the image data. Therefore, for example, if the corresponding latch data (see FIG. 3) is at high level, the driving nozzles are driven to print dots. On the other hand, if the latch data is at low level, the driving nozzles are not driven and no dots are printed. Furthermore, the "non-driving nozzles" selected by the restriction pattern are the nozzles nz driving of which is limited. The non-driving nozzles are not driven regardless of whether the latch data is at high or low level. Dots corresponding to the non-driving nozzles can be printed by the nozzles which correspond to the non-driving nozzles and are the driving nozzles in a nozzle array (for example, Lb to Ld) different from the nozzle array (for example, La) to which the non-driving nozzles belong. This completes printing of the dots corresponding to the image data.

Note that for example, if some nozzles nz are selected as driving nozzles, the remaining nozzles nz can be set as non-driving nozzles. Alternatively, if some nozzles nz are selected as non-driving nozzles, the remaining nozzles nz can be set as driving nozzles. That is, selection of driving nozzles and non-driving nozzles by the restriction pattern is substantially equivalent to selection of driving nozzles or non-driving nozzles by the restriction pattern.

Figure 7B:
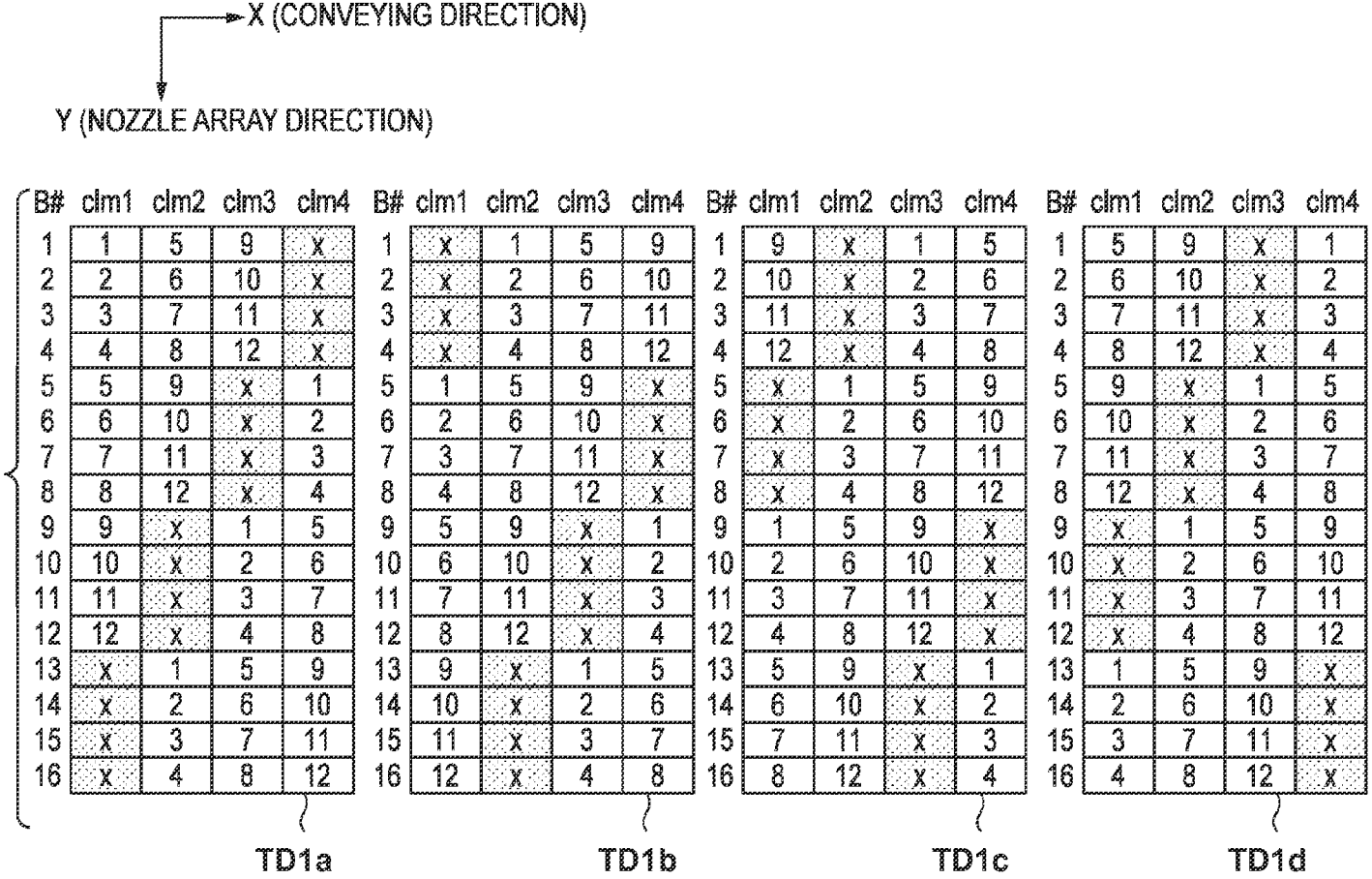

FIG. 7B shows the driving order of the driving nozzles selected based on each of the above restriction patterns. For example, the ROM 143 stores in advance a driving order reference table for defining the driving order (block driving order) of the nozzles nz of each group G. It is possible to set the driving order of the driving nozzles based on each restriction table with reference to the driving order reference table. For the sake of simplicity, a case in which the driving order of the driving nozzles complies with the order of the block numbers will be exemplified.

For example, in a driving order TD1*a* of the driving nozzles in the nozzle array La1, the nozzles are driven in the order of B#1, B#2, . . . , B#12 with respect to the column clm1, and thus the nozzle array La prints dots for the column clm1. The nozzles are driven in the order of B#13, B#14, B#15, B#16, B#1, B#2, . . . , B#8 with respect to the column clm2, and thus the nozzle array La prints dots for the column clm2.

The phases of the cycles of the block driving orders defined in the driving order reference table are shifted by 90° between the respective nozzle arrays L. Therefore, for example, in a driving order TD1*b* of the driving nozzles in the nozzle array Lb, the nozzles are driven in the order of B#5, B#6, . . . , B#16 with respect to the column clm1, and thus the nozzle array Lb prints dots for the column clm1. The nozzles are driven in the order of B#1, B#2, . . . , B#12 with respect to the column clm2, and thus the nozzle array Lb prints dots for the column clm2. Note that the same applies to a driving order TD1*c* of the driving nozzles in the nozzle array Lc, a driving order TD1*d* of the driving nozzles in the nozzle array Ld, and the remaining columns clm3 and clm4.

FIG. 7C shows a priority level reference table TP1 for defining the priority level or priority order of driving of each driving nozzle. The table TP1 is a reference table for specifying a driving nozzle to be preferentially driven when printing one or more dots in a corresponding column by two or more driving nozzles having the same block number. The table TP1 is referred to, based on the image data (four-level data of one of levels 0 to 3) which have been stored in advance in the ROM 143 and have undergone the quantization processing in S130, thereby determining a driving target from the selected driving nozzles.

For example, "cda" is defined for B#1 of the column clm1, which indicates that the nozzle array Lc has the highest priority, the nozzle array Ld has the second highest priority, and the nozzle array La has the lowest priority. For example, consider a case in which among the image data having undergone the quantization processing in S130, data corresponding to B#1 of the column clm1 is at level 1, that is, the number of dots to be printed is 1. In this case, one dot is printed at a print position corresponding to B#1 of the column clm1 by the nozzle nz of B#1 of the nozzle array Lc having the highest priority.

Furthermore, for example, "dac" is defined for B#2 of the column clm1, which indicates that the nozzle array Ld has the highest priority, the nozzle array La has the second highest priority, and the nozzle array Lc has the lowest priority. For example, consider a case in which among the image data having undergone the quantization processing in S130, data corresponding to B#2 of the column clm1 is at level 2, that is, the number of dots to be printed is 2. In this case, two dots are printed at a print position corresponding to B#2 of the column clm1 by the nozzle nz of B#2 of the nozzle array Ld having the highest priority and the nozzle nz of B#2 of the nozzle array La having the second highest priority.

Figure 8A:
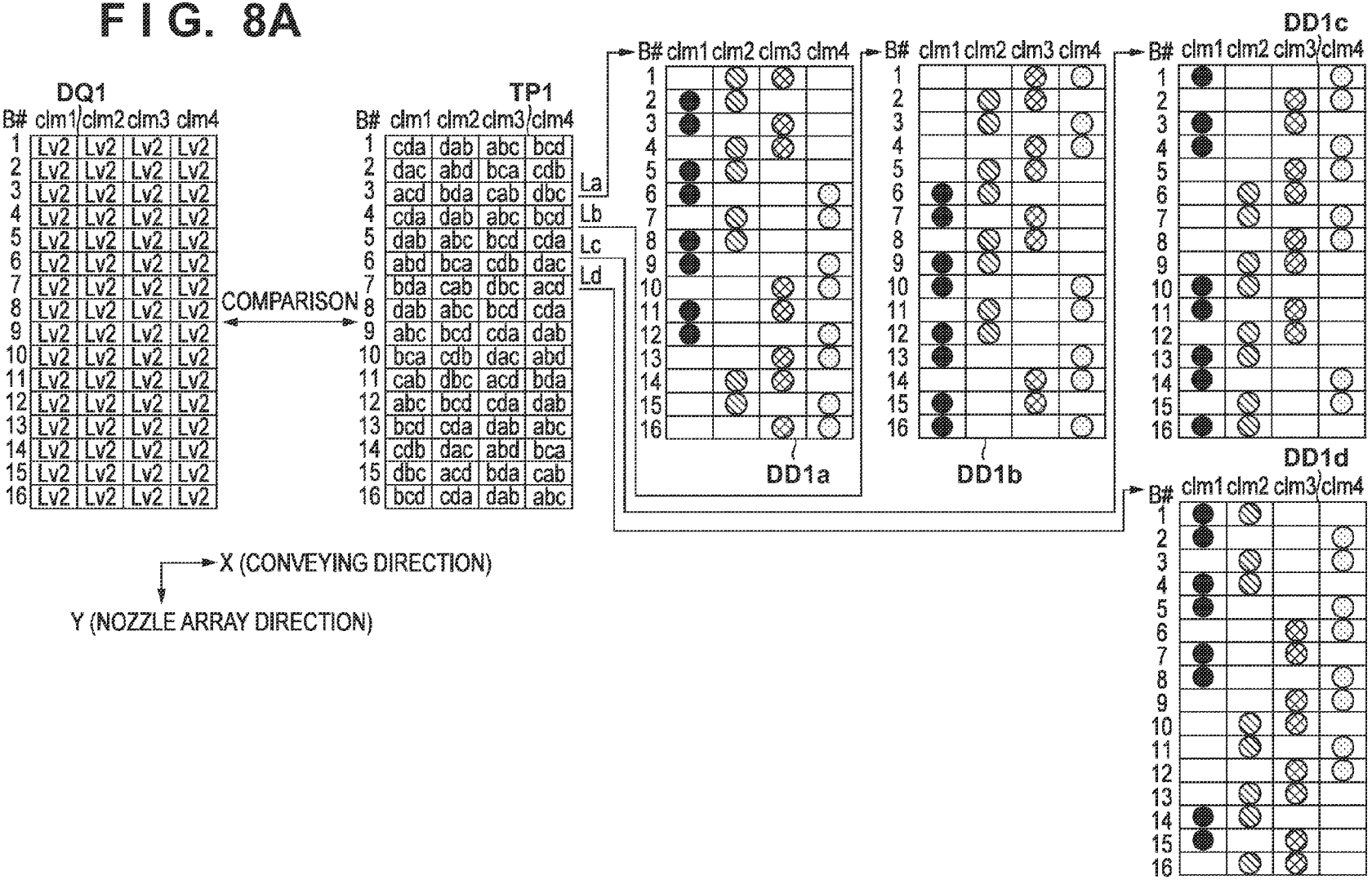
FIGS. 8A and 8B are views for explaining an example of the print data processing method and examples of dots formed on a printing medium.

FIG. 8A is a view for explaining an example of a method of distributing image data DQ1 having undergone the quantization processing in S130 to the respective nozzle arrays La to Ld. For the sake of simplicity, consider a case in which data corresponding to each column and each block in the image data DQ1 is at level 2.

Image data DD1*a* to DD1*d* respectively assigned to the nozzle arrays La to Ld are dot data each indicating whether to print dots, and are generated based on the image data DQ1 and the above-described priority level reference table TP1. More specifically, the specific nozzle array L whose driving nozzle is to be used to print a dot corresponding to data corresponding to each column and each block in the image data DQ1 is determined based on the priority level of driving of each driving nozzle.

In this example, since the priority levels of B#1 of the column clm1 are indicated by "cda", dot data (indicated by a solid circle in FIG. 8A) is assigned to a portion corresponding to B#1 of the column clm1 of each of the image data DD1*c* and DD1*d*. Thus, two dots are printed at the print position corresponding to B#1 of the column clm1 by the driving nozzles of B#1 of the nozzle arrays Lc and Ld.

Similarly, since the priority levels of B#2 of the column clm1 are indicated by "dac", dot data (indicated by a solid circle in FIG. 8A) is assigned to a portion corresponding to B#2 of the column clm1 of each of the image data DD1*d* and DD1*a*. Thus, two dots are printed at the print position corresponding to B#2 of the column clm1 by the driving nozzles of B#2 of the nozzle arrays Ld and La. The same applies to the remaining block numbers B#3 to B#16 and the remaining columns clm2 to clm4.

The thus generated image data DD1*a* to DD1*d* are distributed to the corresponding nozzle arrays La to Ld, respectively.

Figure 8B:
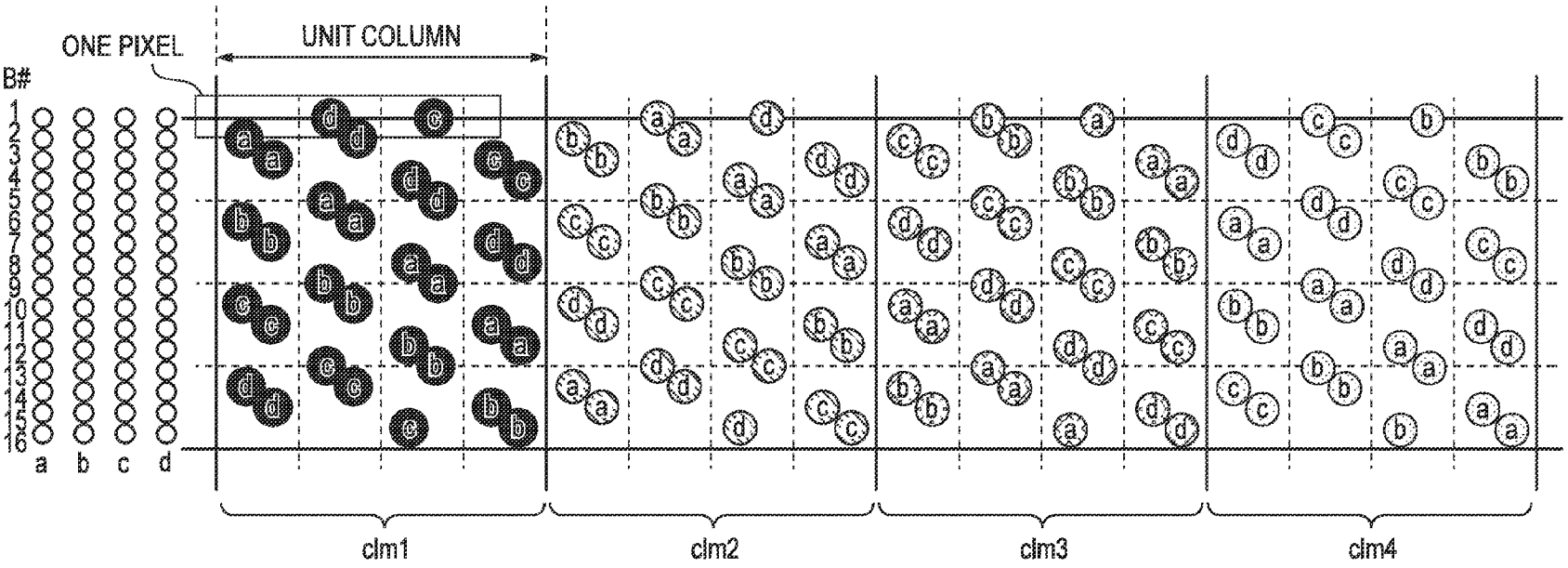

FIG. 8B is a view for explaining dots on the sheet P, which have been printed by the nozzle array La and the like based on the distributed image data DD1*a* and the like. The driving nozzles of the nozzle array La and the like are sequentially driven according to the driving order TD1*a* and the like described with reference to FIG. 7B, and print dots based on the distributed image data DD1*a* and the like. As described above, in each column corresponding to 1,200 dpi, a dot is printed by each nozzle nz selected as a driving nozzle in the column data corresponding to the column.

Note that for the sake of simplicity, a symbol is assigned to each dot in FIG. 8B so as to recognize one of the nozzle arrays La to Ld whose driving nozzle has printed the dot. For example, a dot with "a" is a dot printed by the driving nozzle of the nozzle array La. The same applies to "b" to "d".

For example, in the column clm1, the nozzles nz of B#13 to B#16 of the nozzle array La are non-driving nozzles. Dots corresponding to B#13 to B#16 are printed by the nozzles nz of B#13 to B#16 which are driving nozzles in the nozzle arrays Lb to Ld other than the nozzle array La. Similarly, in the column clm2, the nozzles nz of B#9 to B#12 of the nozzle array La are non-driving nozzles, and dots corresponding to B#9 to B#12 are printed by the nozzles nz of B#9 to B#12 which are driving nozzles in the remaining nozzle arrays Lb to Ld.

As for each column data, this driving method selects some of the plurality of nozzles nz of each nozzle array L as non-driving nozzles, and selects the remaining nozzles nz as driving nozzles. The non-driving nozzles are selected so the non-driving nozzles do not overlap each other between the nozzle arrays L in the conveying direction X of the sheet P. That is, a dot corresponding to a non-driving nozzle of a given nozzle array (for example, the nozzle array La) is printed by a driving nozzle of another nozzle array (for example, one of the nozzle arrays Lb to Ld), thereby completing printing of dots corresponding to the image data.

When the conveying speed of the sheet P is increased to improve the throughput, if all the plurality of nozzles nz of each nozzle array L are driven, the print positions of some dots fall outside the corresponding columns. To print these dots in the corresponding columns, for example, it is necessary to increase the operation speed of each nozzle array L, for example, the driving frequency of each nozzle array L, leading to an increase in manufacturing cost by, for example, changing the design of hardware.

To solve this problem, according to this driving method, some of the plurality of nozzles nz are selected as non-driving nozzles and their driving is limited, and dots corresponding to the non-driving nozzles are printed by driving nozzles of another nozzle array different from a nozzle array to which the non-driving nozzles belong. Consequently, this driving method can appropriately print all dots in the corresponding columns without changing the operation speed of each nozzle array L, and is advantageous in improving the throughput of the printing apparatus while suppressing the manufacturing cost. The driving nozzles and non-driving nozzles are shifted for each column data (in other words, the nozzles nz which serve as non-driving nozzles for given column data are driven as driving nozzles for the next column data), thereby effectively using all the plurality of nozzles nz.

(2-2. Preliminary Discharge on Sheet)

In the inkjet printing apparatus 100, the viscosity of ink in the nozzle nz whose driving frequency is relatively low may increase due to ink evaporation, and clogging (more specifically, an ink droplet discharge failure or the like) of the nozzle nz may occur. To solve this problem, each of all the nozzles nz substantially performs preliminary discharge (one of recovery processes of the nozzle nz) at a predetermined interval regardless of the driving frequency, independently of the image data. As for the above-described full-line printhead, preliminary discharge (to be referred to as "preliminary discharge on a sheet" hereinafter) is performed on the sheet P while printing images corresponding to the image data on the sheet P. Dots printed by preliminary discharge on the sheet are printed on the sheet P at a density which has no influence on the visibility, and are discretely printed in at least one of the conveying direction X and the nozzle array direction Y.

More specifically, in this arrangement for performing preliminary discharge on the sheet, for example, the image data having undergone the distribution processing described with reference to FIGS. 5A to 5C and 6 can be combined with data for preliminary discharge. In terms of printing of dots by preliminary discharge, both the image data and data for preliminary discharge may be collectively referred to as "print data", and the print data can be regarded as data corresponding to dots for forming an image and dots for preliminary discharge. In other words, the combined data of the image data and data for preliminary discharge is supplied to each nozzle array L of the printhead 110 as print data, and each nozzle array L performs preliminary discharge on the sheet in accordance with the data for preliminary discharge while printing the images corresponding to the image data.

Generation of print data by combining the data need only be performed by ORing (obtaining the OR of) the image data and the data for preliminary discharge. More specifically, print data corresponding to each column and each block can be generated by ORing data corresponding to each column and each block in the image data and data corresponding to each column and each block in the data for preliminary discharge. That is, in a portion corresponding to a given block of a given column, print data is set to 1 when one or both the image data and the data for preliminary discharge are 1 (a dot is printed), and is set to 0 when both the data are 0 (no dot is printed).

With the above method, each nozzle nz performs preliminary discharge at the predetermined internal to prevent clogging, thereby maintaining the quality of an image formed on the sheet P.

As described above, since the driving nozzles and non-driving nozzles are selected for each column data, and driving of the non-driving nozzles is limited, if the non-driving nozzles are preliminary discharge targets, they cannot perform preliminary discharge. It is, therefore, necessary to change or generate, in accordance with the selection result, the data for preliminary discharge to be combined.

Figure 9:
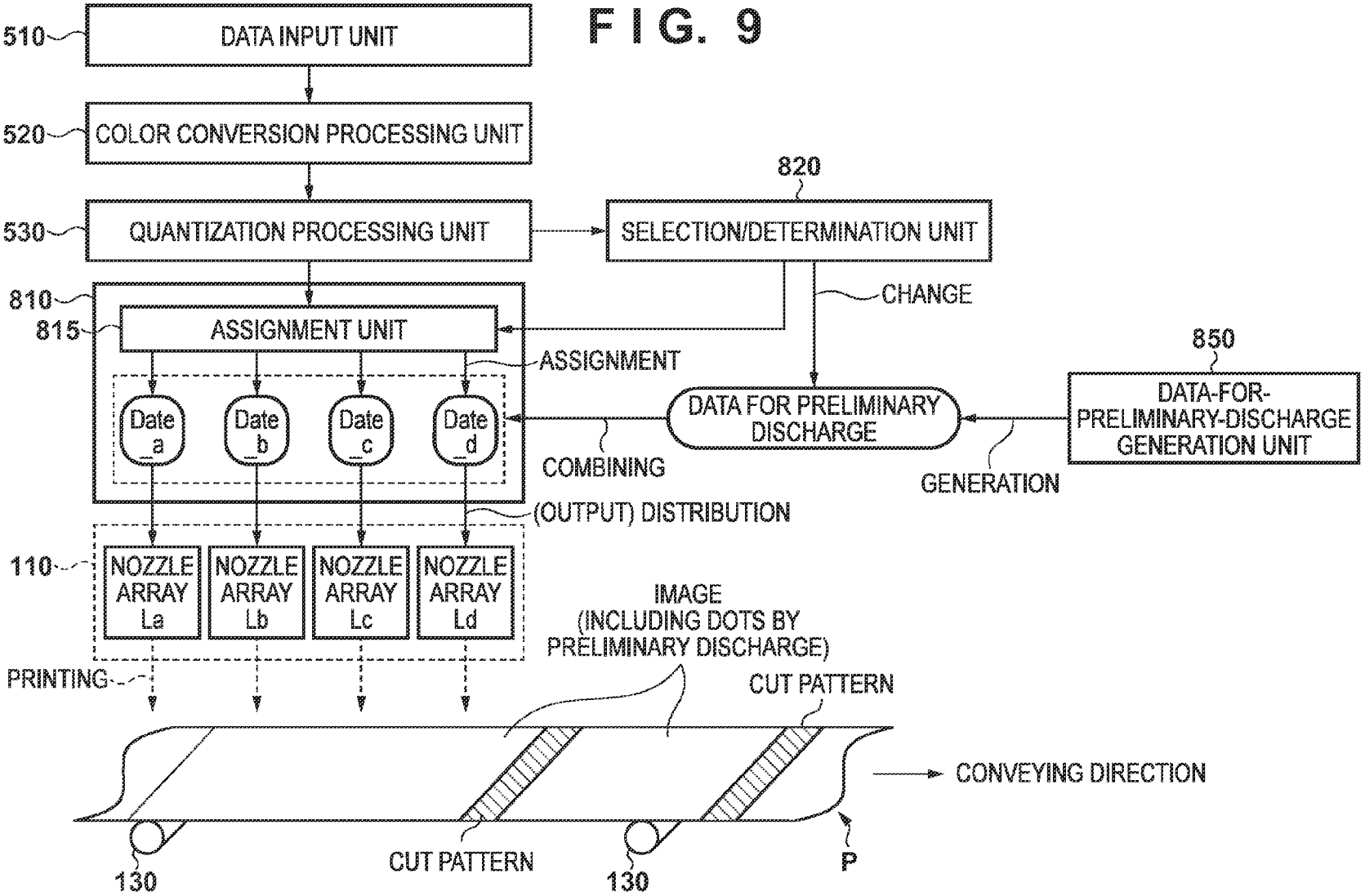
FIG. 9 is a block diagram for explaining an example of a method of changing data for preliminary discharge.

FIG. 9 exemplifies a block diagram for explaining a data flow in the apparatus 100 for performing preliminary discharge on the sheet. As described with reference to FIG. 5B, the image data input from the data input unit 510 undergo the color conversion processing by the color conversion processing unit 520, undergo the quantization processing by the quantization processing unit 530, and are then converted into four-level data (levels 0 to 3). A selection/determination unit 820 selects driving nozzles and non-driving nozzles according to the same procedure as that described above, receives the converted image data, and determines driving nozzles to be driven.

An assignment unit 815 of a distribution processing unit 810 assigns the converted image data to the respective nozzle arrays L based on the result of selection or determination by the selection/determination unit 820. Image data Data_a and the like shown in FIG. 9 correspond to image data assigned to the nozzle array La and the like.

Based on, for example, a predetermined program, a data-for-preliminary-discharge generation unit 850 generates data for preliminary discharge to be used by each nozzle nz to perform preliminary discharge at the predetermined internal, and the generated data for preliminary discharge can be changed based on the result of selection or determination by the selection/determination unit 820. That is, the data for preliminary discharge can be generated or changed so that dots corresponding to the data are printed by the driving nozzles among the driving nozzles and non-driving nozzles. For example, if a given dot corresponding to the data for preliminary discharge corresponds to a given nozzle nz selected as a non-driving nozzle, the data for preliminary discharge is changed so that printing is performed by the nozzle nz when the nozzle nz is set as a driving nozzle. This allows each nozzle nz to substantially perform preliminary discharge at the predetermined interval (at another timing when the nozzle is a non-driving nozzle). Note that the data-for-preliminary-discharge generation unit 850 may change the data for preliminary discharge upon receiving the result of selection or determination by the selection/determination unit 820 or a data-for-preliminary-discharge change unit (not shown) may change the data for preliminary discharge.

The data for preliminary discharge is combined with the corresponding image data Data_a and the like to generate print data. The distribution processing unit 810 outputs and distributes the print data (including the image data Data_a and the like and the data for preliminary discharge) generated by the combining operation to the corresponding nozzle arrays L of the printhead 110. Each nozzle array L of the printhead 110 performs preliminary discharge on the sheet according to the data for preliminary discharge of the print data while printing images corresponding to the image data Data_a and the like of the print data. A cut pattern as a mark for cutting the sheet P for every page unit may be formed between adjacent images on the sheet P.

Note that this arrangement is merely an exemplary arrangement for changing the data for preliminary discharge. The control unit 140 may include dedicated arithmetic processing units corresponding to the unit 520 and the like, or the CPU 141 may have functions corresponding to the units.

Note that as described with reference to FIG. 2A, each nozzle array L is formed by the plurality of nozzle substrates 111 arranged in a staggered pattern, and there are portions overlapping each other between the two nozzle substrates 111 adjacent to each other in the conveying direction. In this case, the data for preliminary discharge need only be distributed to one of the overlapping portions, and distributed to the other portion at the time of next preliminary discharge. That is, the overlapping portions need only be alternately set as a preliminary discharge target.

(2-3. Example of Method of Changing Data for Preliminary Discharge)

Figure 10:
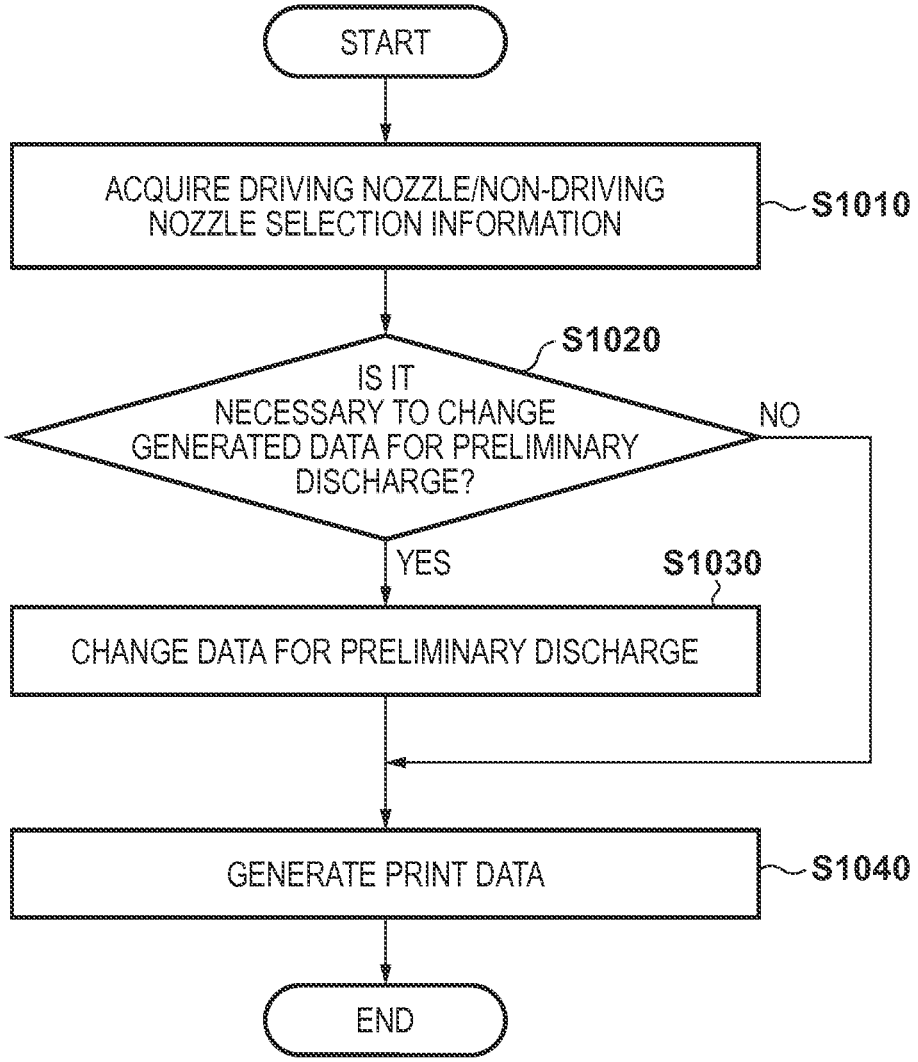
FIG. 10 is a flowchart for explaining an example of the method of changing data for preliminary discharge.

FIG. 10 is a flowchart for explaining an example of a method of changing the data for preliminary discharge. In S1010, information indicating the nozzles nz selected as driving nozzles or non-driving nozzles is acquired for each column data.

In S1020, the data for preliminary discharge which has been generated based on the predetermined program and is to be used by each nozzle nz to perform preliminary discharge at the predetermined interval is compared with the information acquired in S1010, and it is determined whether each of dots corresponding to the data for preliminary discharge corresponds to a non-driving nozzle. If each of the dots corresponding to the data for preliminary discharge corresponds to a non-driving nozzle, the process advances to S1030; otherwise, the process advances to S1040 to generate print data by combining the data for preliminary discharge and the image data, thereby terminating the procedure.

In S1030, the data for preliminary discharge is changed so that the data position of a portion corresponding to a non-driving nozzle in the data for preliminary discharge moves by, for example, one column. After that, the process advances to S1040 to generate print data by combining the data for preliminary discharge and the image data, thereby terminating the procedure.

Figure 11:
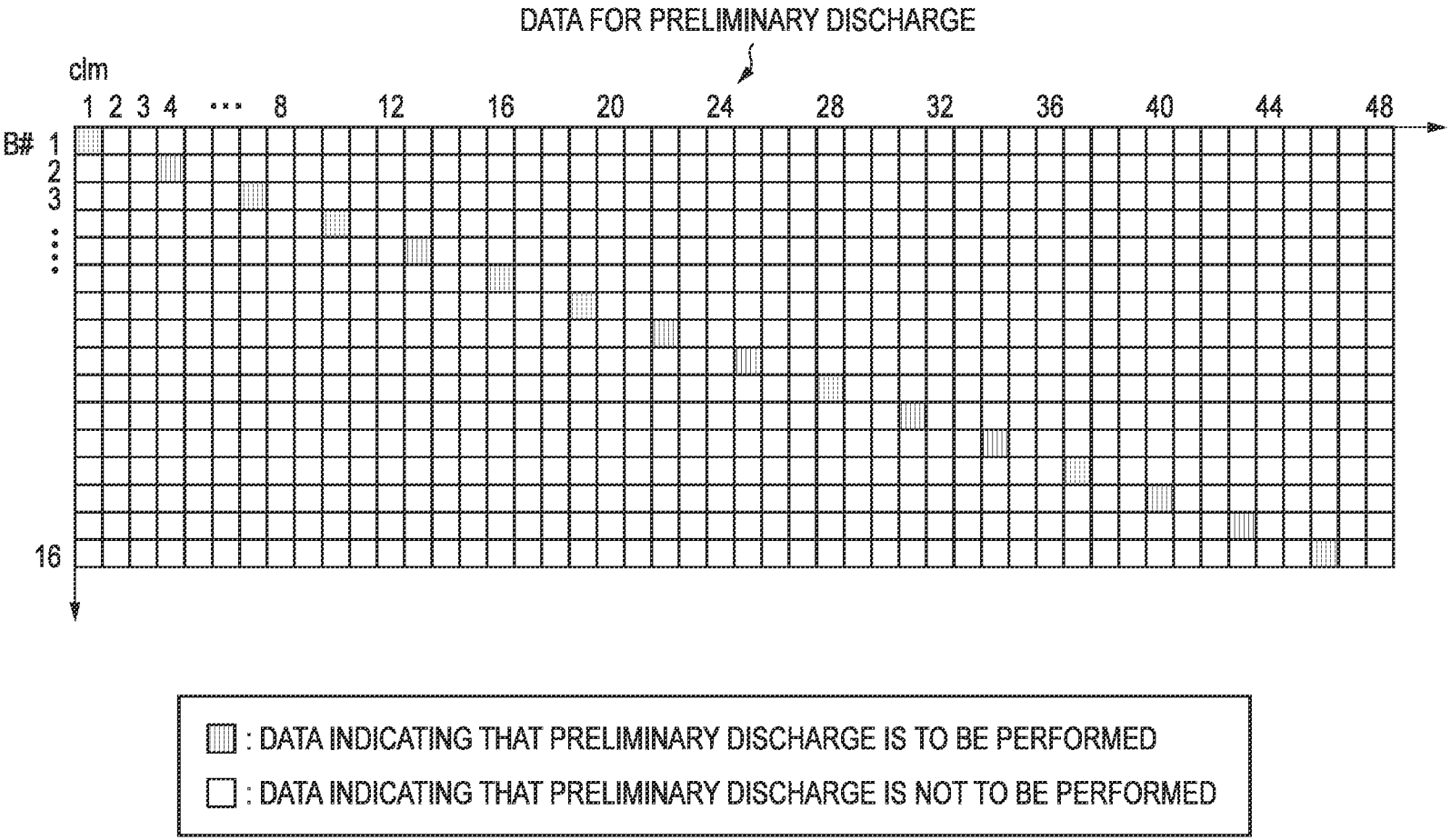
FIG. 11 is a view for explaining an example of data for preliminary discharge.

FIG. 11 shows an example of the data for preliminary discharge to be used by each nozzle nz to perform preliminary discharge at the predetermined interval. For the sake of simplicity, portions corresponding to the 16 blocks, that is, B#1 to B#16 of a unit group of the data for preliminary discharge are shown for the respective columns clm1 to clm48. For the sake of simplicity, in the data for preliminary discharge, portions indicating that preliminary discharge is to be performed are hatched.

In this example, the nozzle nz of B#i is expected to perform preliminary discharge in the column clm(3×i−2) where i is an integer of 1 to 16. More specifically, the nozzle nz of B#1 is expected to perform preliminary discharge in the column clm1, and the nozzle nz of B#2 is expected to perform preliminary discharge in the column clm4. The same applies to the nozzles nz of B#3 to B#16. The same preliminary discharge processing as that in the columns clm1 to clm48 can be repeated in a column clm49 and subsequent columns (none are shown). That is, in this example, each nozzle nz is expected to repeatedly perform preliminary discharge at a period corresponding to the column data for 48 columns.

Note that the period of preliminary discharge (that is, an internal at which each nozzle is expected to print a dot by preliminary discharge) is not limited to that in this example, and can be set for each ink color. The data for preliminary discharge may be generated based on a predetermined pattern of dots for preliminary discharge, or individually generated so that each nozzle performs preliminary discharge at a period corresponding to each ink color based on the pattern.

Figure 12A:
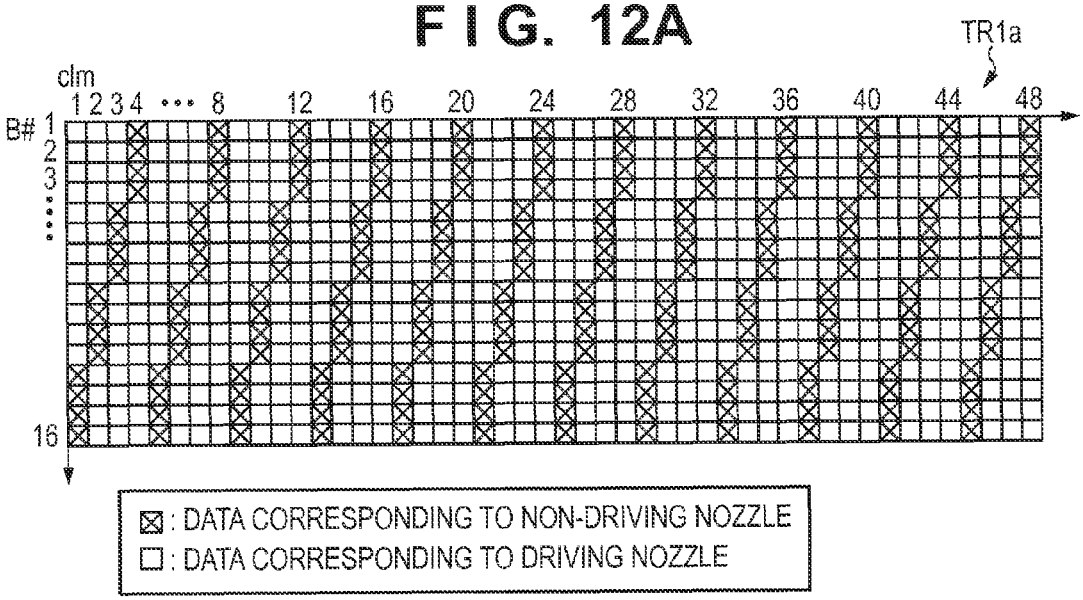
FIGS. 12A and 12B are views for explaining an example of data corresponding to a restriction pattern.
Figure 12B:
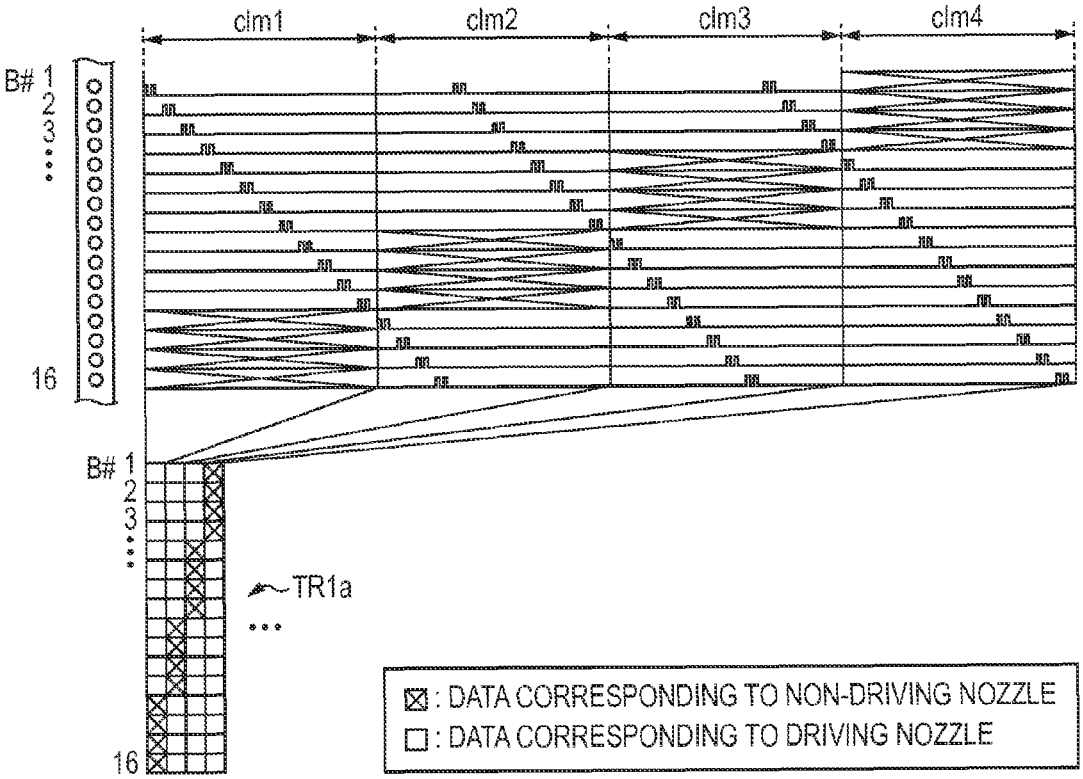

FIG. 12A shows data which corresponds to the restriction pattern TR1*a* described with reference to FIG. 7A and corresponds to the columns clm1 to clm48 for the nozzle array La. FIG. 12B exemplifies portions corresponding to the four columns clm1 to clm4 of the data and a corresponding timing chart of the driving nozzles. For the sake of simplicity, a mark "x" is added to each of portions corresponding to the non-driving nozzles in the data corresponding to the restriction pattern TR1*a*, and these portions are hatched in the timing chart.

Note that in the timing chart shown in FIG. 12B, waveforms for driving the respective driving nozzles by double-pulse control are exemplified. More specifically, a driving signal for driving the nozzle nz includes a preheat pulse which heats ink near the nozzle nz to be driven and does not discharge ink and a main heat pulse for heating and discharging the ink.

As described with reference to FIGS. 7A to 7C, the nozzles nz of B#13 to B#16 of the column clm1, B#9 to B#12 of the column 2, B#5 to B#8 of the column clm3, and B#1 to B#4 of the column clm4 are selected as non-driving nozzles (indicated by the marks "x"). Driving of each non-driving nozzle is limited in the corresponding column. Therefore, if the nozzle nz selected as a non-driving nozzle for given column data is set as a preliminary discharge target for the corresponding column on the sheet P, it cannot perform preliminary discharge for the corresponding column. This will be described with reference to FIGS. 13A and 13B.

Figure 13A:
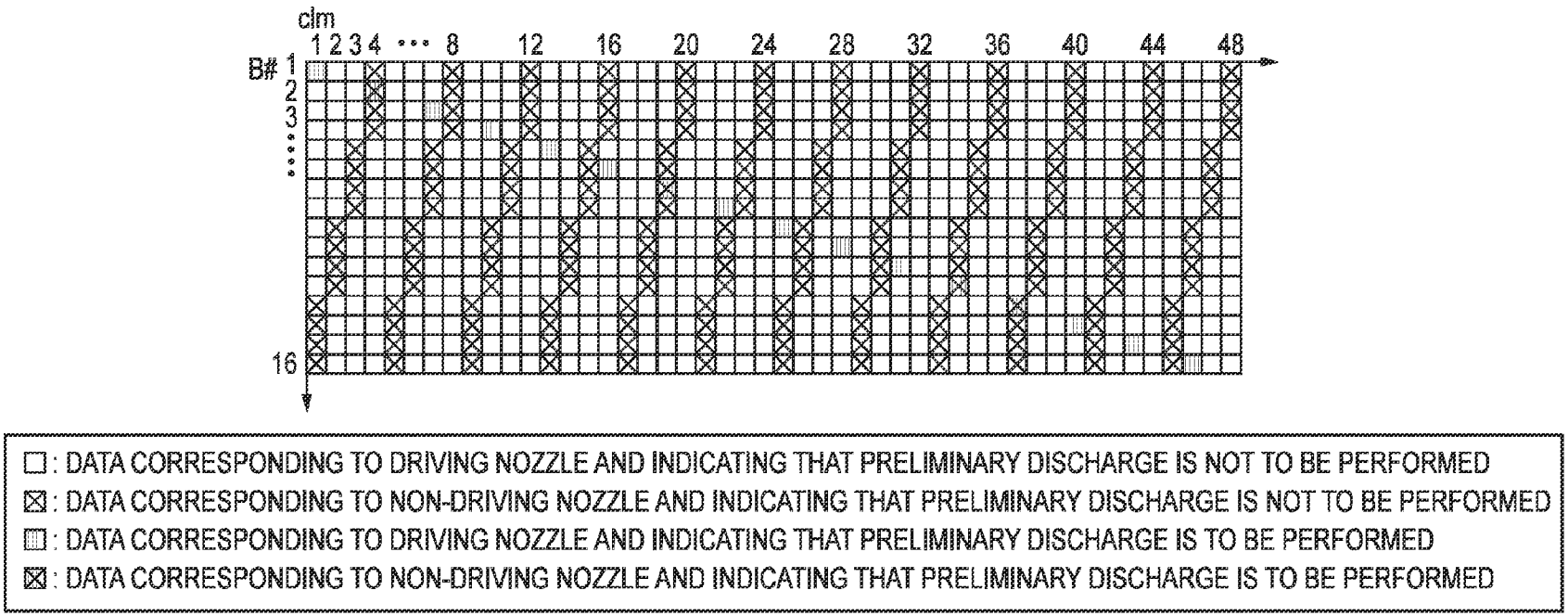
FIGS. 13A and 13B are views for explaining an example of the data for preliminary discharge changed in correspondence with the restriction pattern.

FIG. 13A shows the data for preliminary discharge exemplified in FIG. 11 by adding the marks "x" to portions corresponding to the non-driving nozzles in the data for preliminary discharge. That is, FIG. 13A is a view showing data obtained by superimposing the data for preliminary discharge exemplified in FIG. 11 and the data corresponding to the restriction pattern TR1*a* exemplified in FIG. 12A.

Referring to FIG. 13A, in the column clm4, the nozzle nz of B#2 selected as a non-driving nozzle is a preliminary discharge target. Similarly, in the columns clm19, clm34, and clm37, the nozzles nz of B#7, B#12, and B#13 selected as non-driving nozzles are preliminary discharge targets. Driving of each of the non-driving nozzles is limited, and each of the nozzles cannot perform preliminary discharge for the corresponding column.

Figure 13B:
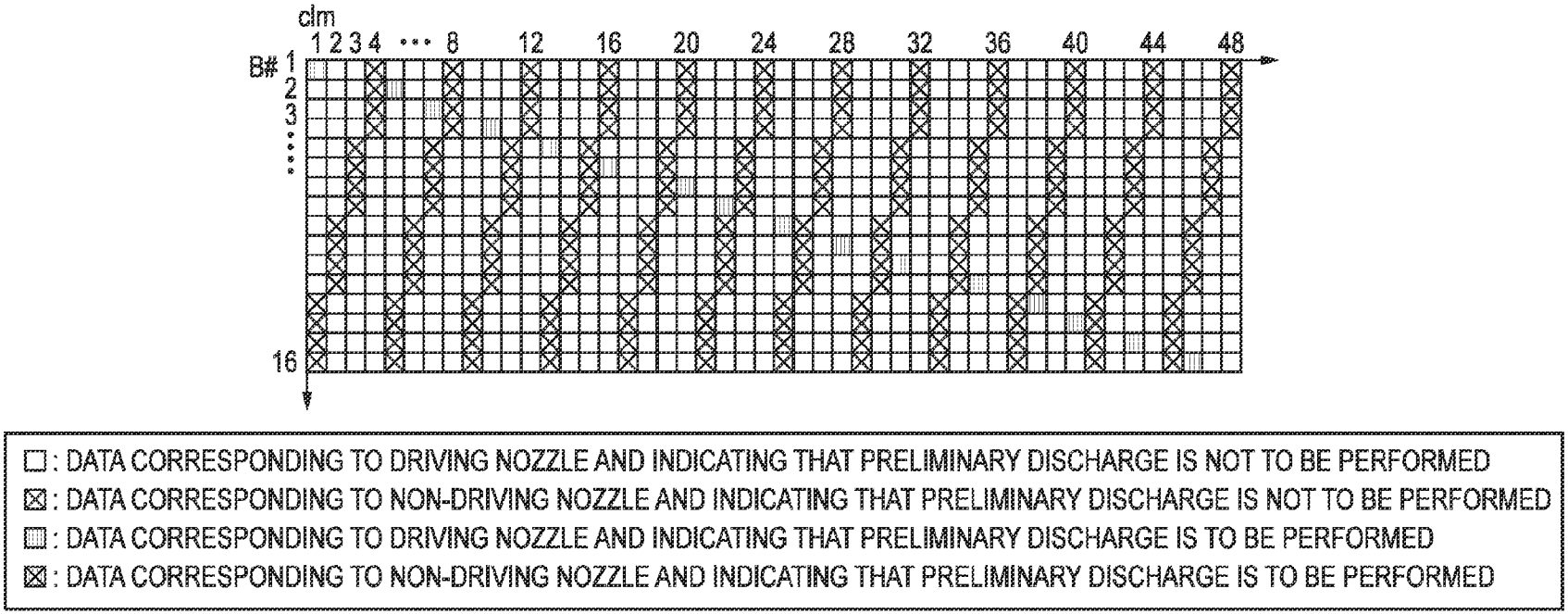

FIG. 13B shows the data for preliminary discharge changed according to the change method described with reference to FIG. 10 by adding the marks "x" to the portions corresponding to the non-driving nozzles in the data for preliminary discharge. When the data for preliminary discharge is generated, for example, the nozzle nz of B#2 is expected to perform preliminary discharge in the column clm4. However, referring to FIG. 13B, the data for preliminary discharge has been changed so that the nozzle nz of B#2 performs preliminary discharge in the column clm5. Similarly, the data for preliminary discharge has been changed so that the nozzles nz of B#7, B#12, and B#13 perform preliminary discharge in the columns clm20, clm35, and clm38, respectively.

That is, among the data (hatched portions in FIG. 13B) indicating that preliminary discharge is to be performed, the data positions of the portions overlapping the portions (indicated by the marks "x" in FIG. 13B) corresponding to the non-driving nozzles have been moved by one column. In the columns corresponding to the moved data positions, the nozzles nz as preliminary discharge targets are selected as driving nozzles, and can thus perform preliminary discharge.

According to the method of changing the data for preliminary discharge, each nozzle nz can substantially perform preliminary discharge at the predetermined interval (at another timing when the nozzle is a non-driving nozzle). This can prevent clogging of each nozzle nz, and maintain the quality of an image formed on the sheet P.

Note that in the example shown in FIG. 13B, a case in which the data positions of the portions corresponding to the non-driving nozzles in the data for preliminary discharge are moved by one column in a direction (the right direction in FIG. 13B) in which the preliminary discharge timing is delayed has been exemplified. However, the moving amount and moving direction of the data positions are not limited to them, and the data positions may be moved in a direction (the left direction in FIG. 13B) in which the preliminary discharge timing is advanced).

(2-4. Summary of Embodiment)

According to this embodiment, some of the plurality of nozzles nz are selected as non-driving nozzles and their driving is limited, and thus dots corresponding to the non-driving nozzles are printed by driving nozzles of another nozzle array different from that to which the non-driving nozzles belong. Note that driving nozzles and non-driving nozzles are selected in advance when, for example, performing distribution processing of print data having undergone a series of data processes. In this method, even if the conveying speed of the sheet P is increased, it is possible to appropriately print all dots in corresponding columns without changing the operation speed of each nozzle array L. Therefore, this method is advantageous in improving the throughput of the printing apparatus while suppressing the manufacturing cost.

According to this embodiment, preliminary discharge on a sheet is performed while printing an image on the sheet P by the above driving method. Data for preliminary discharge used to perform preliminary discharge on a sheet is changed according to the result of selection of driving nozzles and non-driving nozzles, and each nozzle nz substantially performs preliminary discharge at a predetermined interval (at another timing when the nozzle is a non-driving nozzle). This can maintain the quality of the image formed on the sheet P.

As described above, this embodiment is advantageous in performing preliminary discharge on a sheet while maintaining the print speed with a simple and low-end arrangement.

(2-5. Others)

Although the printhead 110 including the four nozzle arrays La to Ld has been exemplified in this embodiment, the number of nozzle arrays is not limited to this and need only be two or more. For example, when the printhead 110 includes L nozzle arrays and each group G includes M nozzles nz where L represents an integer of 2 or more and M represents an integer of 2 or more and an multiple of L, M/L nozzles nz may be selected as non-driving nozzles. Note that the arrangement in which the nozzle array La and the like print dots of the same color has been exemplified. However, this embodiment is not limited to this as long as each nozzle can print a dot of an arbitrary color.

Although the arrangement of the full-line printhead 110 has been exemplified in this embodiment, the present invention may be applied to the arrangement of a serial printhead for performing printing by alternately repeating scanning of the printhead and conveyance of the printing medium.

(3. Second Embodiment)

The second embodiment will be described with reference to FIGS. 14A, 14B, 15A, and 15B. A case in which the block driving order complies with the order of the block numbers has been exemplified in the above-described first embodiment for the sake of simplicity. The present invention, however, is not limited to this, and other block driving orders may be adopted. In this embodiment, the block driving order is not the order of block numbers, and complies with shuffled block numbers. Such driving method will also be referred to as "distributed driving" hereinafter.

Figure 14A:
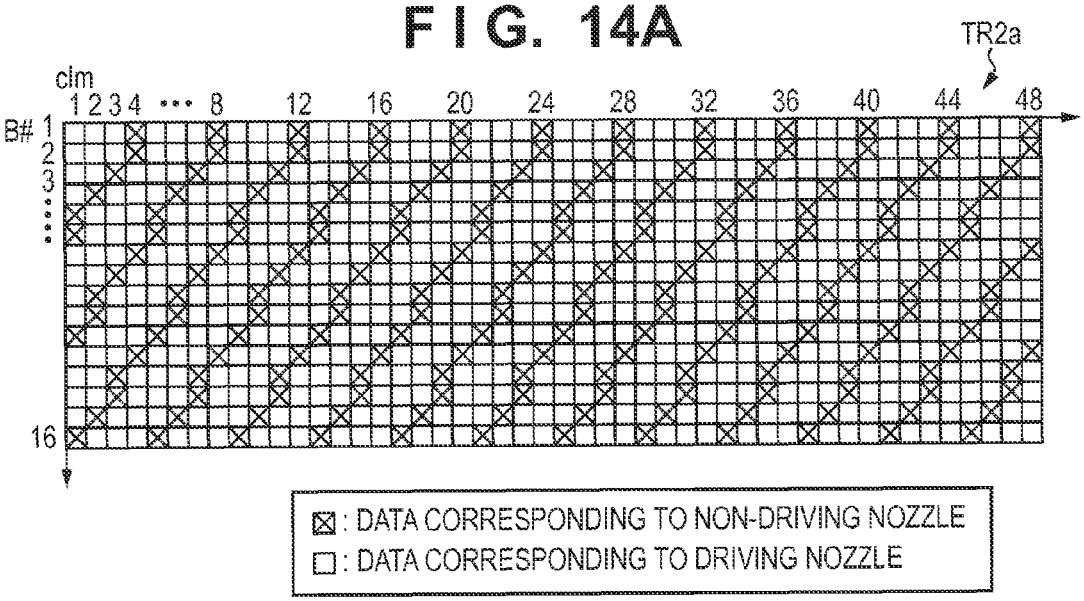
FIGS. 14A and 14B are views for explaining an example of data corresponding to a restriction pattern.
Figure 14B:
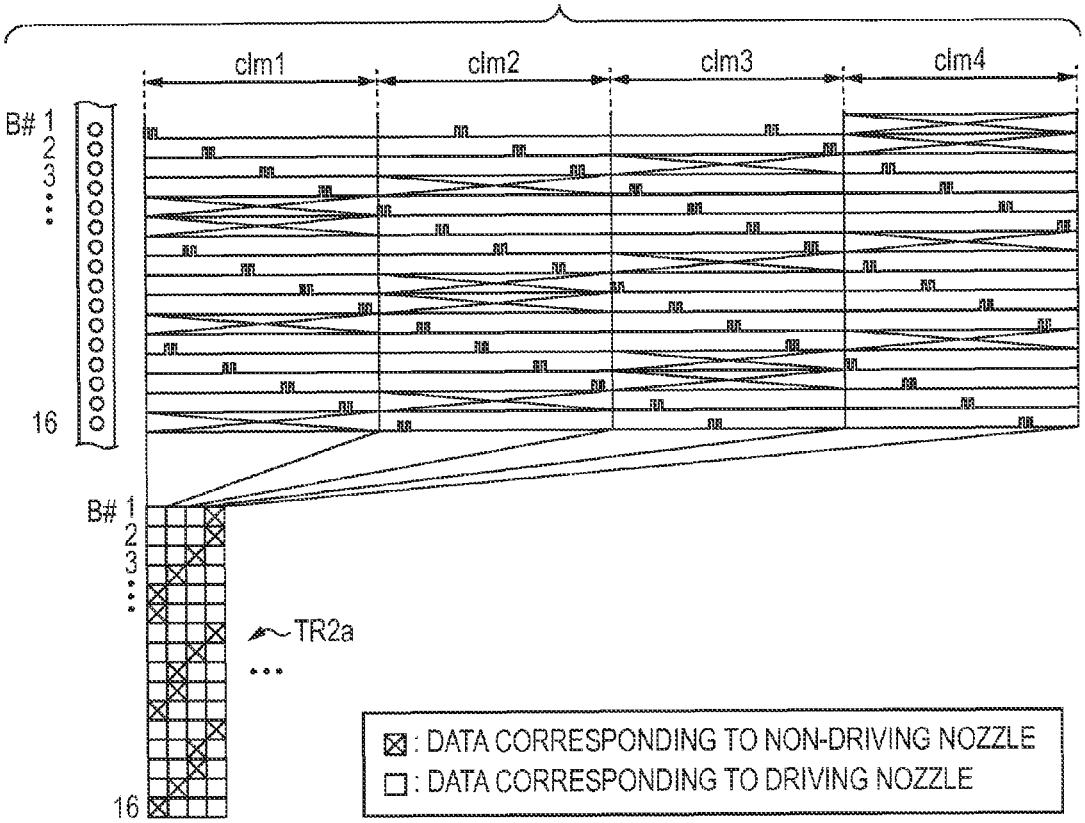

FIG. 14A exemplifies data corresponding to a restriction pattern TR2*a* according to this embodiment, similarly to FIG. 12A. FIG. 14B exemplifies portions corresponding to four columns clm1 to clm4 of the data and a corresponding timing chart of driving nozzles, similarly to FIG. 12B.

In this embodiment, in the column clm1, nozzles nz of B#5, B#6, B#11, and B#16 are non-driving nozzles and the remaining nozzles nz are driving nozzles. Although not shown, the driving nozzles are driven in the order of B#1, B#12, B#7, B#2, B#13, B#8, B#3, B#14, B#9, B#4, B#15, and B#10, and the non-driving nozzles of B#5, B#6, B#11, and B#16 are not driven.

Similarly, in the column clm2, nozzles of B#4, B#9, B#10, and B#15 are non-driving nozzles and the remaining driving nozzles are driven in the order of B#5, B#16, B#11, B#6, B#1, B#12, B#7, B#2, B#13, B#8, B#3, and B#14. In the column clm3, nozzles of B#3, B#8, B#13, and B#14 are non-driving nozzles and the remaining driving nozzles are driven in the order of B#9, B#4, B#15, B#10, B#5, B#16, B#11, B#6, B#1, B#12, B#7, and B#2. In the column clm4, nozzles of B#1, B#2, B#7, and B#12 are non-driving nozzles and the remaining driving nozzles are driven in the order of B#13, B#8, B#3, B#14, B#9, B#4, B#15, B#10, B#5, B#16, B#11, and B#6.

FIG. 15A shows the data for preliminary discharge exemplified in the first embodiment (see FIG. 11) by adding marks "x" to portions corresponding to the non-driving nozzles in the data for preliminary discharge. Referring to FIG. 15A, in the column clm4, the nozzle nz of B#2 selected as a non-driving nozzle is a preliminary discharge target. Similarly, in the columns clm7, clm10, and clm13, the nozzles nz of B#3, B#4, and B#5 selected as non-driving nozzles are preliminary discharge targets. Since driving of each of these non-driving nozzles is limited, each of the non-driving nozzles cannot perform preliminary discharge for the corresponding column.

FIG. 15B shows the data for preliminary discharge changed according to the change method described in the first embodiment (see FIG. 10) by adding the marks "x" to the portions corresponding to the non-driving nozzles in the data for preliminary discharge. When the data for preliminary discharge is generated, for example, the nozzle nz of B#2 is expected to perform preliminary discharge in the column clm4. However, referring to FIG. 15B, the data for preliminary discharge has been changed so that the nozzle nz of B#2 performs preliminary discharge in the column clm5. Similarly, the data for preliminary discharge has been changed so that the nozzles nz of B#3, B#4, and B#5 perform preliminary discharge in the columns clm5, clm8, and clm11, respectively.

According to this embodiment, therefore, it is possible to obtain the same effects as those in the above-described first embodiment. Distributed driving is advantageous in an inkjet method since the influence of heat energy, generated by driving of the nozzle nz of a given block, on the nozzle nz of an adjacent block is reduced. Note that an example of the driving order of distributed driving has been exemplified but the driving order is not limited to this, and may be changed for, for example, every print job of a predetermined unit, every predetermined column data, or every predetermined period.

(4. Third Embodiment)

The third embodiment will be described with reference to FIGS. 16, 17A, and 17B. A case in which the order of dots to be printed by preliminary discharge complies with the order of block numbers has been exemplified in the first and second embodiments for the sake of simplicity. However, the present invention is not limited to this, and the order of dots to be printed by preliminary discharge may be another order. In this embodiment, the order of dots to be printed by preliminary discharge is not the order of block numbers, and complies with shuffled block numbers.

Note that a pattern of dots to be printed by preliminary discharge in the first and second embodiments will be referred to as a "sequential pattern" hereinafter. To the contrary, a pattern of dots to be printed by preliminary discharge in this embodiment will be referred to as a "distributed pattern" hereinafter.

Figure 16:
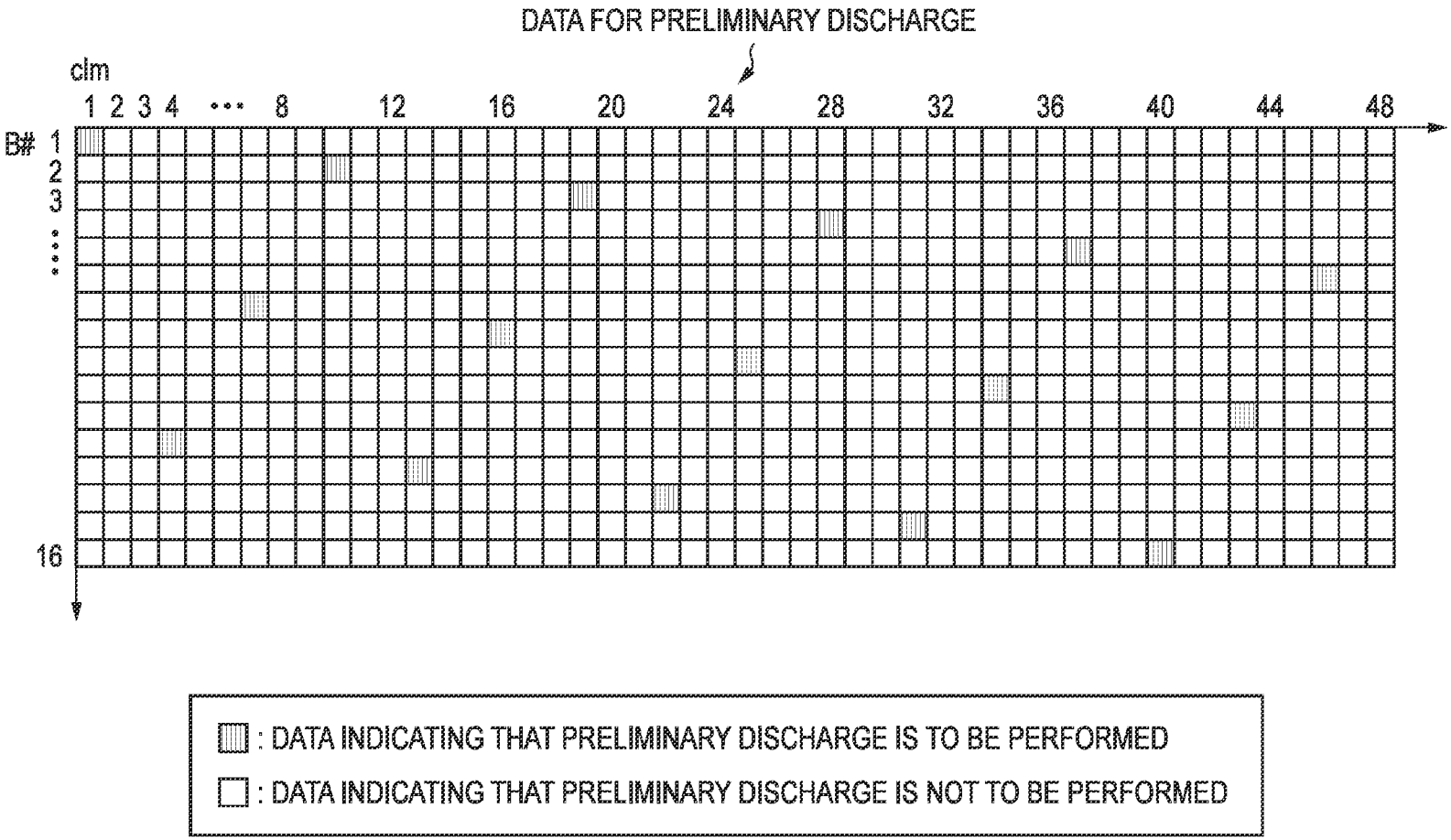
FIG. 16 is a view for explaining an example of data for preliminary discharge.

FIG. 16 shows an example of a distributed pattern according to this embodiment, similarly to FIG. 11. In this example, 16 nozzles nz in a unit group sequentially perform preliminary discharge in the order of B#1, B#12, B#7, B#2, B#13, B#8, B#3, B#14, B#9, B#4, B#15, B#10, B#5, B#16, B#11, and B#6. Dots printed by the preliminary discharge operations of the nozzles nz are printed in columns clm1, clm4, clm7, clm10, clm13, clm16, clm19, clm22, clm25, clm28, clm31, clm34, clm37, clm40, clm43, and clm46, respectively.

Figure 17A:
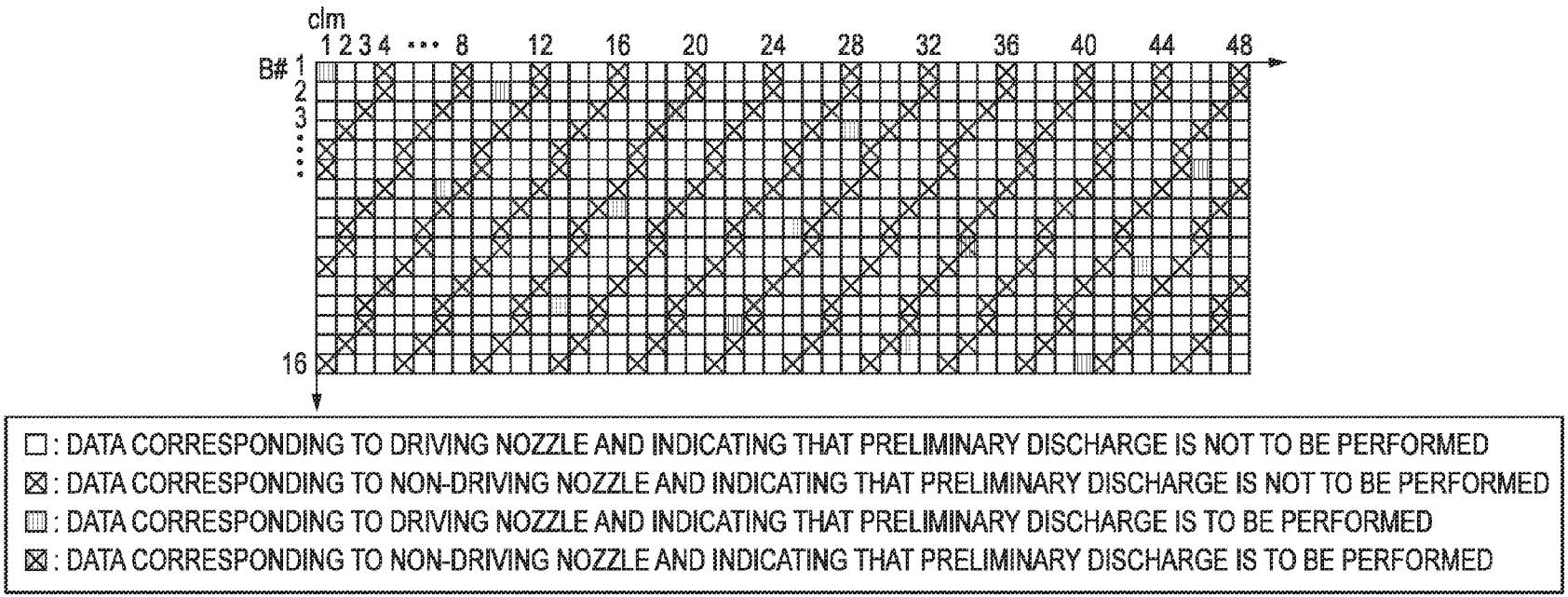
FIGS. 17A and 17B are views for explaining an example of the data for preliminary discharge changed in correspondence with a restriction pattern.

FIG. 17A shows the data for preliminary discharge exemplified in the first embodiment (see FIG. 11) by adding marks "x" to portions corresponding to non-driving nozzles in the data for preliminary discharge. Note that the non-driving nozzles are the same as in the second embodiment (consider a case in which non-driving nozzles are selected based on the restriction pattern TR2*a* in the second embodiment).

Referring to FIG. 17A, in the column clm4, the nozzle nz of B#12 selected as a non-driving nozzle is a preliminary discharge target. Similarly, in the columns clm19, clm34, and clm37, the nozzles nz of B#3, B#10, and B#5 selected as non-driving nozzles are preliminary discharge targets.

Since driving of each of these non-driving nozzles is limited, each of the non-driving nozzles cannot perform preliminary discharge for the corresponding column.

Figure 17B:
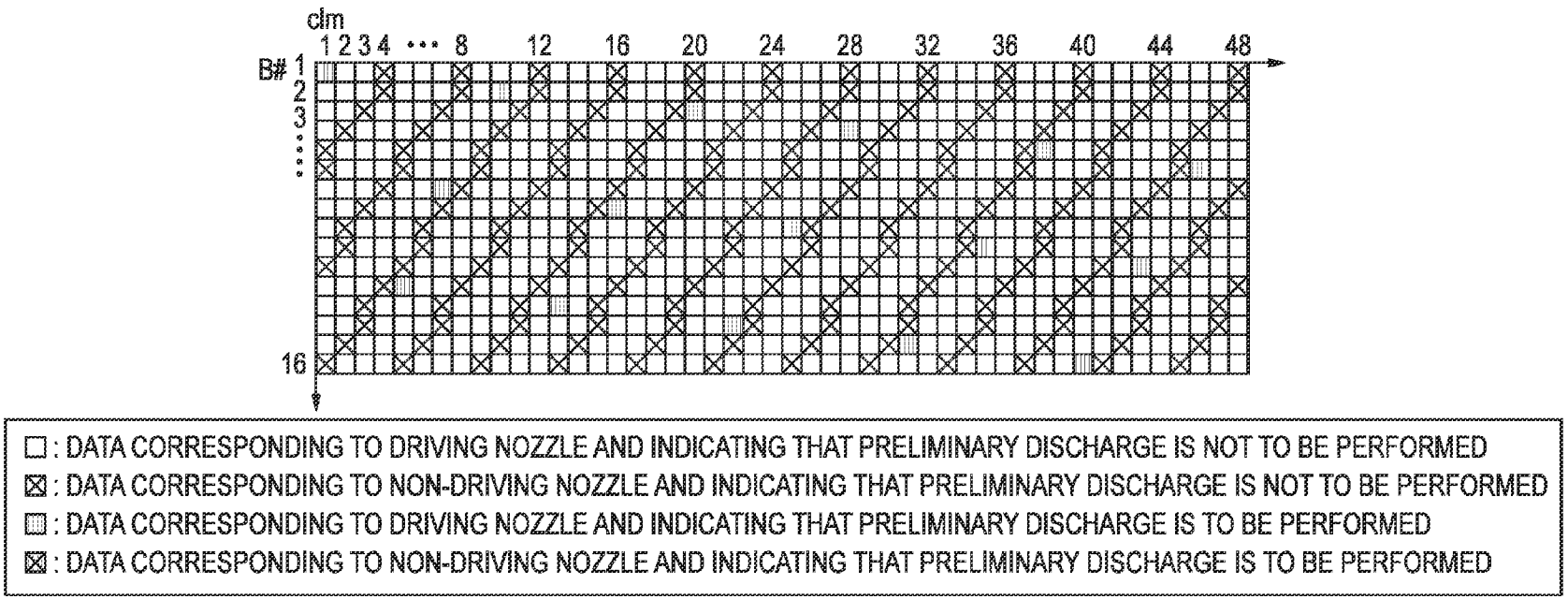

FIG. 17B shows the data for preliminary discharge changed according to the change method described in the first embodiment (see FIG. 10) by adding the marks "x" to the portions corresponding to the non-driving nozzles in the data for preliminary discharge. When the data for preliminary discharge is generated, for example, the nozzle nz of B#12 is expected to perform preliminary discharge in the column clm4. However, referring to FIG. 17B, the data for preliminary discharge has been changed so that the nozzle nz of B#12 performs preliminary discharge in the column clm5. Similarly, the data for preliminary discharge has been changed so that the nozzles nz of B#3, B#10, and B#5 perform preliminary discharge in the columns clm20, clm35, and clm38, respectively.

According to this embodiment, therefore, it is also possible to obtain the same effects as those in each of the above-described embodiments. A distributed pattern is further advantageous in maintaining the image quality since it is possible to make it more difficult to visually confirm dots printed by preliminary discharge on a sheet. Note that although an example of a distributed pattern has been exemplified, the order of dots to be printed by preliminary discharge is not limited to this, and may be changed for every print job of a predetermined unit, every predetermined column data, or every predetermined period.

(5. Others)

The three preferred embodiments of the present invention have been exemplified above with reference to a printing apparatus including an inkjet full-line printhead. The present invention, however, is not limited to these embodiments, and the embodiments may partially be changed or their features may be combined in accordance with the purpose or the like.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

In addition, the present invention is applicable to another aspect without departing from the spirit and scope of the present invention. For example, although an inkjet method using heating elements has been exemplified in each of the above-described embodiments, any printing methods such as a method using piezoelectric elements, a method using electrostatic elements, a method using MEMS elements, and other known printing methods may be used.

Furthermore, "printing" can include, in addition to printing of forming significant information such as characters and graphics, printing in a broad sense regardless of whether information is significant or insignificant. For example, "printing" need not be visualized to be visually perceivable by humans, and can also include printing of forming images, figures, patterns, structures, and the like on a printing medium, or printing of processing the medium.

In addition, "printing agent" can include a consumable used for printing in addition to "ink" used in each of the above-described embodiments. For example, "printing agent" can include a liquid which is used to process a printing medium or to process ink (for example, to solidify or insolubilize a colorant in ink applied onto a printing medium) as well as a liquid which is applied onto a printing medium to form images, figures, patterns, and the like. Furthermore, it is possible to adopt, for example, an arrangement configured to perform printing by applying ink onto an intermediate transfer medium and then transferring the ink onto a printing medium, instead of an arrangement configured to directly apply ink onto a printing medium. It is also possible to use an arrangement configured to perform monochrome printing using one type of ink (for example, black ink), instead of an arrangement configured to perform color printing using a plurality of types of inks.

In addition, "printing medium" can include any media capable of receiving a printing agent, such as cloth, plastic films, metal plates, glass, ceramics, resin, wood, and leather, as well as paper used in general printing apparatuses.

The definition of each term used in this specification for the sake of simplicity should be interpreted without departing from the spirit and scope of the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-206672, filed Oct. 7, 2014, which is hereby incorporated by reference herein in its entirety.

What is claimed is:

1. A printing apparatus including an inkjet printhead with at least two nozzle arrays arranged in a first direction, each nozzle array including a plurality of nozzles arranged along a second direction intersecting the first direction, the apparatus comprising:

a conveying unit configured to convey a longitudinally long-shaped sheet in the first direction;

a driving unit configured to drive the printhead so that each nozzle performs preliminary discharge on the sheet conveyed by the conveying unit while printing a dot based on print data; and a unit that performs the following operations:

a first operation of expanding image data onto a memory in correspondence with the first and second directions, for each nozzle array of every column data corresponding to the second direction in the expanded image data, a second operation of selecting some of the plurality of nozzles as non-driving nozzles that do not overlap between the nozzle arrays in the first direction, and selecting the remaining nozzles of the plurality of nozzles as driving nozzles, a third operation of determining image data of the expanded image data to be assigned to each nozzle array so that each column data indicating driving of a nozzle is assigned only to a nozzle array to which the driving nozzle belongs or to another nozzle array different from a nozzle array to which the non-driving nozzle belongs when the column data corresponds to a non-driving nozzle, a fourth operation of generating data for preliminary discharge corresponding to the image data determined in the third operation to discretely perform preliminary discharge by the plurality of nozzles on the sheet in at least one of the first and second directions, by setting the column data as data for the nozzle to perform preliminary discharge when the nozzle selected as the driving nozzle for column data is set as a preliminary discharge target, and another column data which is different from the column data and in which the nozzle is selected as the driving nozzle in the second operation, as data used by the nozzle to perform preliminary discharge when the nozzle selected as the non-driving nozzle for column data is set as a preliminary discharge target, and a fifth operation of generating print data by a logical sum of the image data determined in the third operation and the data for preliminary discharge generated in the fourth operation, and outputting the generated print data to each nozzle array.

2. The apparatus according to claim 1, further comprising:

a storage unit configured to store information for specifying which of the plurality of nozzles of each nozzle array has limited driving, wherein selection of the limited driving nozzles is based on identification of the non-driving nozzles.

3. The apparatus according to claim 1, wherein in the fourth operation the unit generates data for preliminary discharge so that each nozzle performs preliminary discharge on the sheet in the first direction at a predetermined interval, and if a nozzle as a preliminary discharge target is a non-driving nozzle, the unit generates data for preliminary discharge so that the nozzle is set as a preliminary discharge target when the nozzle is selected as a driving nozzle.

4. The apparatus according to claim 1, wherein in the fourth operation the unit generates data for preliminary discharge so that each nozzle performs preliminary discharge on the sheet in the first direction at a predetermined interval, and if the non-driving nozzle selected in the second operation for given column data is a preliminary discharge target, the unit generates data for preliminary discharge so that the newly selected driving nozzle is set as a preliminary discharge target when the non-driving nozzle is newly selected as a driving nozzle in the second operation for next column data.

5. The apparatus according to claim 3, wherein the printing apparatus is a color printer and the predetermined interval is different for each color.

6. The apparatus according to claim 1, wherein the unit further performs a series of operations from the first operation to the fifth operation for next print data of the print data when the printhead completes printing based on part of the print data output in the fifth operation.

7. The apparatus according to claim 1, wherein the driving unit time-divisionally drives the driving nozzles of each nozzle array based on the print data output in the fifth operation.

8. The apparatus according to claim 7, wherein the driving unit sequentially drives the driving nozzles selected in the second operation in accordance with the selection result.

9. The apparatus according to claim 7, wherein the driving unit time-divisionally drives (M−M/L) driving nozzles of each group of each nozzle array, where L (L is an integer not less than 2) represents the number of nozzle arrays, the plurality of nozzles of each nozzle array are divided into N (N is an integer not less than 2) groups each including M (M is an integer not less than 2 and a multiple of L) nozzles, and in the second operation the unit selects M/L nozzles of each group for each nozzle array as the non-driving nozzles, and selects (M−M/L) nozzles except for the M/L, nozzles of each group as the driving nozzles.

10. The apparatus according to claim 7, wherein a time required to time-divisionally drive all the driving nozzles of the plurality of nozzles of each nozzle array is a unit period of the time-divisional driving, and in every unit period in the second operation, the unit selects some other nozzles of the plurality of nozzles of each nozzle array as new non-driving nozzles, and selects the nozzles other than the newly selected non-driving nozzles of the plurality of nozzles as new driving nozzles.

11. The apparatus according to claim 1, wherein the printhead is a full-line printhead.

12. A driving method for a printing apparatus including an inkjet printhead with at least two nozzle arrays arranged in a first direction, each nozzle array including a plurality of nozzles arranged along a second direction intersecting the first direction, the printing apparatus further including a conveying unit configured to convey a longitudinally long-shaped sheet in the first direction, and a driving unit configured to drive the printhead so that each nozzle performs preliminary discharge on the sheet conveyed by the conveying unit while printing a dot based on print data, the method comprising:

a first step of expanding image data onto a memory in correspondence with the first and second directions, for each nozzle array for every column data corresponding to the second direction in the expanded image data, a second operation of selecting some of the plurality of nozzles as non-driving nozzles that do not overlap between the nozzle arrays in the first direction, and selecting the remaining nozzles of the plurality of nozzles as driving nozzles, a third step of determining image data of the expanded image to be assigned to each nozzle array so that each column data indicating driving of a nozzle is assigned only to a nozzle array to which the driving nozzle belongs or to another nozzle array different from a nozzle array to which the non-driving nozzle belongs when the column data corresponds to a non-driving nozzle, a fourth step of generating data for preliminary discharge corresponding to the image data determined in the third step to discretely perform preliminary discharge by the plurality of nozzles on the sheet in at least one of the first and second directions, by setting the column data as data for the nozzle to perform preliminary discharge when the nozzle selected as the driving nozzle for column data is set as a preliminary discharge target, and another column data that is different from the column data and in which the nozzle is selected as the driving nozzle in the second step, as data used by the nozzle to perform preliminary discharge when the nozzle selected as the non-driving nozzle for column data is set as a preliminary discharge target, and a fifth step of generating print data by a logical sum of the image data determined in the third step and the data for preliminary discharge generated in the fourth step, and outputting the generated print data to each nozzle array.

* * * * *